US010234169B2

(12) United States Patent
Wells et al.

(10) Patent No.: US 10,234,169 B2
(45) Date of Patent: Mar. 19, 2019

(54) TRANSITION CASTING FOR BOILER WITH STEAM COOLED UPPER FURNACE

(71) Applicant: The Babcock & Wilcox Company, Barberton, OH (US)

(72) Inventors: Eric L Wells, Massillon, OH (US); Roger A Detzel, Uniontown, OH (US); Albert J Bennett, Doylestown, OH (US); Steven D Thayer, Minerva, OH (US)

(73) Assignee: The Babcock & Wilcox Company, Barberton, OH (US)

( * ) Notice: Subject to any disclaimer, the term of this patent is extended or adjusted under 35 U.S.C. 154(b) by 77 days.

(21) Appl. No.: 15/091,173

(22) Filed: Apr. 5, 2016

(65) Prior Publication Data

US 2017/0284700 A1 Oct. 5, 2017

(51) Int. Cl.
*F24H 1/30* (2006.01)
*F22G 7/14* (2006.01)
*F24H 1/40* (2006.01)

(52) U.S. Cl.
CPC ..... *F24H 1/30* (2013.01); *F22G 7/14* (2013.01); *F24H 1/406* (2013.01)

(58) Field of Classification Search
CPC ... F24H 1/30; F24H 1/406; F22G 7/14; F22B 21/345; F22B 21/341; F22B 21/34; F22B 21/343; F22B 21/38; F22B 21/40; F22B 21/36; F22B 21/363; F22B 21/366; F22B 21/32; F22B 37/202
See application file for complete search history.

(56) References Cited

U.S. PATENT DOCUMENTS 3,007,456 A * 11/1961 Murray ..... F22B 21/341 122/33
3,020,894 A * 2/1962 Rowand ..... F01K 3/183 122/33
3,063,431 A * 11/1962 Miller ..... F22B 21/345 122/478
3,768,448 A * 10/1973 Beckman ..... F22G 7/14 122/478
4,418,652 A * 12/1983 Rees ..... F22B 37/125 122/235.12
2011/0209697 A1* 9/2011 Plotkin ..... F24J 2/07 126/663

FOREIGN PATENT DOCUMENTS

GB 231488 A * 2/1926 ..... A61F 6/12

* cited by examiner

*Primary Examiner* — Steven B McAllister
*Assistant Examiner* — Steven S Anderson, II
(74) *Attorney, Agent, or Firm* — Michael J. Seymour

(57) ABSTRACT

Transition castings are disclosed which comprise a steam tube, a water tube, and a pass-through tube, which are joined together by membranes. The ends of the tubes on one vertical end are aligned in a plane, while the ends of the tubes on the other vertical end are aligned in alternating planes, or put another way are angled instead of being in a straight line. The transition castings are used in a transition section of a boiler in which the furnace is divided into a lower furnace and an upper furnace. The lower furnace uses water-cooled membrane walls, while the upper furnace uses steam-cooled membrane walls that act as superheating surfaces. The transition section joins the lower furnace and the upper furnace together.

23 Claims, 16 Drawing Sheets

(perspective view of upper transition casting)

(front view of upper transition casting)

(top view of upper transition casting)

(bottom view of upper transition casting)

(perspective view of lower transition casting)

(front view of lower transition casting)

(top view of lower transition casting)

(bottom view of lower transition casting)

TRANSITION CASTING FOR BOILER WITH STEAM COOLED UPPER FURNACE

BACKGROUND

The present disclosure relates to the boiler arts, with illustrative embodiments including sub-critical boilers, sub-critical natural circulation boilers, coal-fired boilers, sub-critical coal-fired boilers, sub-critical natural circulation coal-fired boilers, and to methods of manufacturing and operating the same. Transition castings are described, along with methods of making and using such, to permit small boilers to attain high superheated steam temperatures greater than about 1000° F., and up to 1100° F.

Small coal-fired boilers find application in diverse settings, such as where power requirements are relatively low (e.g. rural areas, underdeveloped regions), where coal is readily available, and so forth. Typical small coal-fired boilers for electric power generation employ a sub-critical natural circulation design. An example of such a boiler design is the Babcock & Wilcox Carolina-Type Radiant Boiler design. This design employs a furnace with membraned water-cooled furnace walls that feed one or more steam drums. Water passing through the furnace walls absorb heat energy, in effect cooling the tubes/pipes directly exposed to the combustion heat. The steam drum(s) feeds one or more primary superheaters located inside a convection pass, and one or more secondary pendant superheaters located inside the upper portion of the furnace. This superheated steam is used to run a high-pressure turbine. The steam exiting the high-pressure turbine is then sent through reheaters to increase the temperature again, so that the steam can then be used to run a low-pressure turbine.

Water-cooled pipes or tubes are designed to carry wet steam (i.e. a steam/water mixture, or equivalently, steam quality less than 100%). For a given operating pressure, the temperature of wet steam is thermodynamically limited to the boiling temperature of liquid water at the given operating pressure. In practice, water-cooled pipes are designed for an operating temperature of about 650° F.-670° F., corresponding to an operating pressure of about 2200-2600 psig. In a sub-critical boiler, water-cooled pipes feed wet steam into the steam drum.

By contrast, steam-cooled pipes or tubes are designed to carry superheated steam having a steam quality of 100% (i.e., no liquid component). The temperature of superheated steam is not thermodynamically limited for a given pressure, and in Carolina-Type designs the steam-cooled superheaters generally carry superheated steam at temperatures of about 1000° F.-1050° F.

Because of the differences in temperature, water-cooled pipes can be made of lower cost carbon steel, whereas steam-cooled pipes are made of more costly steel compositions. A design such as the Carolina-Type Radiant Boiler advantageously leverages these factors by designing the entire furnace to be water-cooled, so that the membraned walls can use lower cost carbon steel pipes and connecting membranes. The higher alloy superheater components are located within the furnace and convection pass (i.e inside the walls of the boiler), and are not membraned. In such designs, the membraned water-cooled walls are generally cooler than the flue gas to which the steam-cooled superheaters are exposed, due to more efficient heat transfer to the steam/water mixture carried by the water-cooled pipes.

In certain applications, it is desirable to obtain steam at high temperatures after superheating and after reheating, e.g. about 1050° F. after both cycles. This can be difficult in small designs, and further designs and methods are needed to obtain such high temperatures.

BRIEF DESCRIPTION

The present disclosure thus relates to small high pressure sub-critical boilers that can have natural circulation and achieve high superheater temperatures of about 1050° F. Generally, the lower furnace of such boilers uses water-cooled tubes/pipes, and the upper furnace uses steam-cooled tubes/pipes. The upper furnace and the lower furnace are joined to each other through a transition section that is formed of transition castings as described herein.

Disclosed herein in various embodiments are transition castings, comprising: a first steam tube having a steam tube diameter and a steam passageway extending between a front end pointing in a forward direction and a vertical end pointing in a first vertical direction; a first water tube having a water tube diameter and a water passageway extending between a front end pointing in the forward direction and a vertical end pointing in a second vertical direction opposite the first vertical direction; a first pass-through tube having a pass-through tube diameter and a fluid conduit extending between a first vertical end pointing in the first vertical direction and a second vertical end pointing in the second vertical direction; and a membrane joining the first steam tube, the first water tube, and the first pass-through tube to form a pressure seal therebetween; wherein a center of the vertical end of the first steam tube and a center of the first vertical end of the first pass-through tube are aligned in a first plane, and a center of the vertical end of the first water tube is offset from the first plane.

Also disclosed herein in various embodiments are transition castings, comprising: a first steam tube having a steam tube diameter and a steam passageway extending between a front end pointing in a forward direction and a vertical end pointing in a first vertical direction; a first water tube having a water tube diameter and a water passageway extending between a front end pointing in the forward direction and a vertical end pointing in a second vertical direction opposite the first vertical direction; a first pass-through tube having a pass-through tube diameter and a fluid conduit extending between a first vertical end pointing in the first vertical direction and a second vertical end pointing in the second vertical direction; and a membrane joining the first steam tube, the first water tube, and the first pass-through tube to form a pressure seal therebetween; wherein a center of the vertical end of the first steam tube and a center of the first vertical end of the first pass-through tube define a first line; wherein a center of the vertical end of the first water tube and a center of the second vertical end of the first pass-through tube define a second line; and wherein the first line and the second line form an acute angle.

In various embodiments, the first water tube and the first steam tube are both adjacent to a common side of the first pass-through tube.

Sometimes, the front end of the first steam tube is both laterally and vertically offset from the front end of the first water tube. Alternatively, the front end and the vertical end of the first steam tube are vertically offset from each other. The front end and the vertical end of the first water tube may be vertically aligned with each other.

The transition casting may further comprise a heat transfer fin extending from the membrane and abutting the first water tube.

The water tube diameter can be greater than the steam tube diameter. In some embodiments, the pass-through tube diameter is the same as the steam tube diameter. In other embodiments, the pass-through tube diameter is the same as the water tube diameter.

In some particular embodiments, the transition casting further comprises a second pass-through tube having the pass-through tube diameter and a fluid conduit extending between a first vertical end pointing in the first vertical direction and a second vertical end pointing in the second vertical direction; wherein the first steam tube and the first water tube are located vertically relative to each other and are located between the first pass-through tube and the second pass-through tube.

The first vertical ends of the first pass-through tube and the second pass-through tube may be offset in the same lateral direction relative to the second vertical ends of the first pass-through tube and the second pass-through tube.

Two lines joining (i) the second vertical end of the first pass-through tube with the vertical end of the first water tube, and (ii) the vertical end of the first water tube with the second vertical end of the second pass-through tube, may form an obtuse angle.

In other embodiments, the centers of the first vertical ends of the first pass-through tube and the second pass-through tube are closer to each other than the centers of the second vertical ends of the first pass-through tube and the second pass-through tube.

In some transition castings, two lines joining (i) the first vertical end of the first pass-through tube with the vertical end of the first steam tube, and (ii) the vertical end of the first steam tube with the first vertical end of the second pass-through tube, form an obtuse angle.

In some embodiments, the center of the vertical end of the first water tube is offset from the first plane by a distance of about a radius of the first steam tube.

The transition casting can be made of stainless steel.

Also disclosed are boilers, comprising: an upper furnace having steam-cooled membrane walls comprising steam wall tubes; a lower furnace having water-cooled membrane walls comprising water wall tubes; a transition section disposed between the upper furnace and the lower furnace, wherein the transition section comprises an upper transition casting and a lower transition casting that are joined by alternating straight water tubes and straight steam tubes. The upper transition casting comprises an upper steam tube having a steam tube diameter and a steam passageway extending between a front end pointing in a forward direction and an upper end pointing in an upper vertical direction; an upper water tube having a water tube diameter and a water passageway extending between a front end pointing in the forward direction and a lower end pointing in a lower vertical direction; a steam pass-through tube having the steam tube diameter and a fluid conduit extending between an upper end pointing in the upper vertical direction and a lower end pointing in the lower vertical direction; and a membrane joining the upper steam tube, the upper water tube, and the steam pass-through tube to form a pressure seal therebetween; wherein a center of the upper end of the upper steam tube and a center of the upper end of the steam pass-through tube are aligned in a first plane, and a center of the lower end of the upper water tube is offset from the first plane. The lower transition casting comprises a lower steam tube having the steam tube diameter and a steam passageway extending between a front end pointing in the forward direction and an upper end pointing in the upper vertical direction; a lower water tube having the water tube diameter and a water passageway extending between a front end pointing in the forward direction and a lower end pointing in the lower vertical direction; a water pass-through tube having the water tube diameter and a fluid conduit extending between an upper end pointing in the upper vertical direction and a lower end pointing in the lower vertical direction; and a membrane joining the lower steam tube, the lower water tube, and the water pass-through tube to form a pressure seal therebetween; wherein a center of the lower end of the lower steam tube and a center of the lower end of the steam pass-through tube are aligned in a second plane, and a center of the upper end of the lower steam tube is offset from the second plane.

Either transition casting may further comprise a heat transfer fin extending from the membrane wall and abutting the upper water tube.

In various embodiments, the upper steam tube and the lower steam tube are each fluidly connected to a steam inlet header located below the lower transition casting; and the upper water tube and the lower water tube are each fluidly connected to a water outlet header located above the upper transition casting.

The lower furnace may be top-supported through the transition section. The centers of the straight water tubes may be located in a different plane from the centers of the straight steam tubes. The water tube diameter may be greater than the steam tube diameter. The upper transition casting and the lower transition casting may be made of stainless steel.

These and other non-limiting aspects and/or objects of the disclosure are more particularly described below.

BRIEF DESCRIPTION OF THE DRAWINGS

The following is a brief description of the drawings, which are presented for the purposes of illustrating embodiments disclosed herein and not for the purposes of limiting the same.

FIG. 7 is a perspective view. FIG. 8 is a front view. FIG. 9 is a top view, and FIG. 10 is a bottom view.

FIG. 13 is a perspective view. FIG. 14 is a front view. FIG. 15 is a top view, and FIG. 16 is a bottom view.

DETAILED DESCRIPTION

Figure 1:
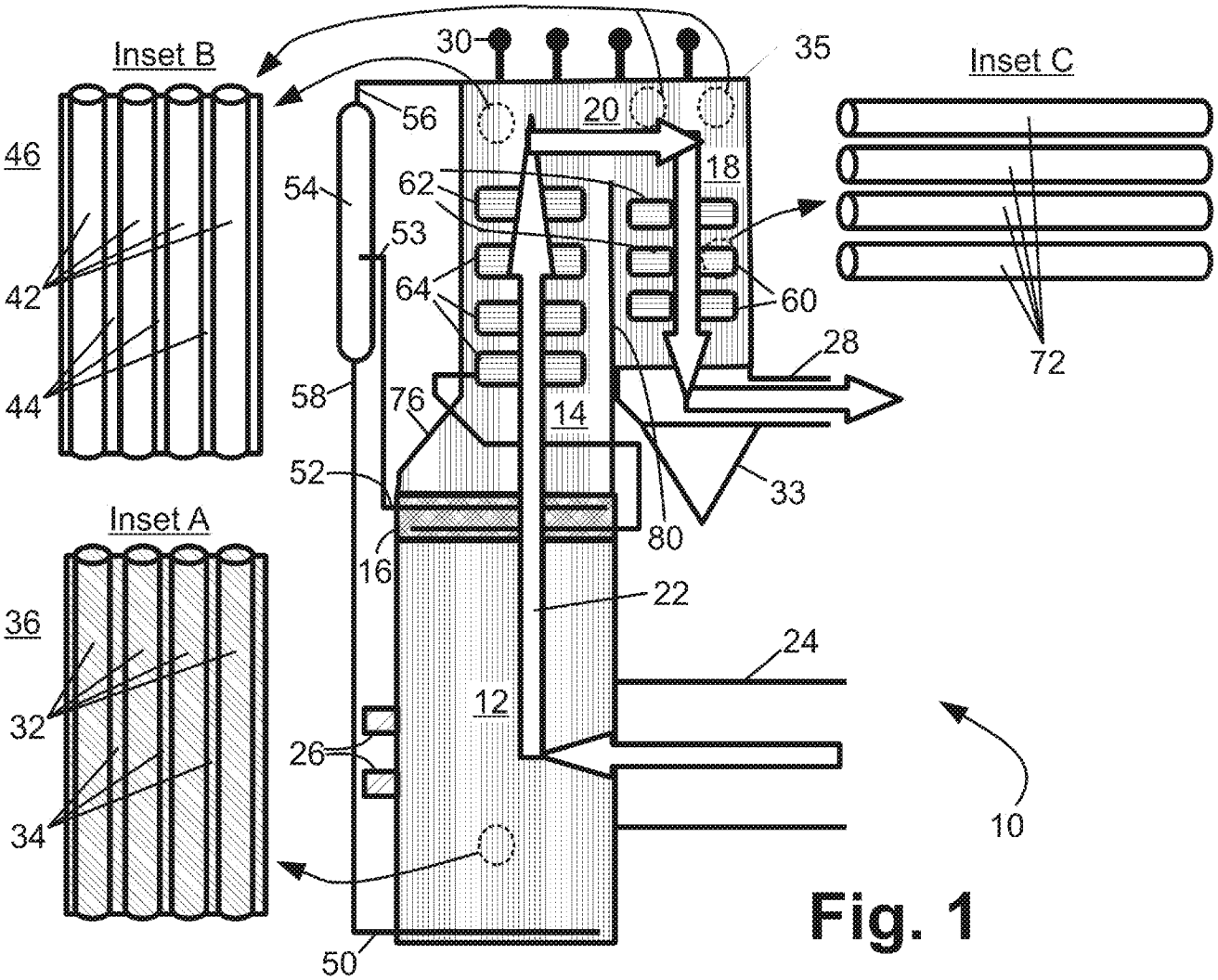
FIG. 1 diagrammatically shows a side-sectional view of an illustrative boiler. Insets A, B, and C illustrate portions of piping.

A more complete understanding of the processes and apparatuses disclosed herein can be obtained by reference to the accompanying drawings. These figures are merely schematic representations based on convenience and the ease of demonstrating the existing art and/or the present development, and are, therefore, not intended to indicate relative size and dimensions of the assemblies or components thereof.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

It should be noted that many of the terms used herein are relative terms. For example, the terms "inlet" and "outlet" are relative to a direction of flow, and should not be construed as requiring a particular orientation or location of the structure. The terms "upstream" and "downstream" are relative to the direction in which a fluid flows through various components, i.e. the fluid flows through an upstream component prior to flowing through the downstream component. It should be noted that in a loop, a first component can be described as being both upstream of and downstream of a second component. Similarly, the terms "upper" and "lower" are relative to each other in location, i.e. an upper component is located at a higher elevation than a lower component.

The terms "horizontal" and "vertical" are used to indicate direction relative to an absolute reference, i.e. ground level. However, these terms should not be construed to require structures to be absolutely parallel or absolutely perpendicular to each other. For example, a first vertical structure and a second vertical structure are not necessarily parallel to each other.

The terms "top" and "bottom" or the terms "roof" and "floor" are used to refer to locations/surfaces where the top/roof is always higher than the bottom/floor relative to an absolute reference, i.e. the surface of the earth. The terms "upwards" and "downwards" are also relative to an absolute reference; an upwards flow is always against the gravity of the earth.

The term "plane" is used herein to refer generally to a common level, and should be construed as referring to a volume, not as a flat surface.

A fluid at a temperature that is above its saturation temperature at a given pressure is considered to be "superheated." The temperature of a superheated fluid can be lowered (i.e. transfer energy) without changing the phase of the fluid. As used herein, the term "wet steam" refers to a saturated steam/water mixture (i.e., steam with less than 100% quality where quality is percent steam content by mass). The terms "wet steam" and "water" may be used interchangeably to describe any steam/water mixture that contains from 0% to about 80% steam (i.e. 20% to 100% water). As used herein, the term "dry steam" refers to steam having a quality equal to or about 100% (i.e., no liquid water is present).

The terms "pipes" and "tubes" are used interchangeably herein to refer to a hollow cylindrical shape, as is commonly understood.

The term "natural circulation", as used herein, refers to the circulation of water through the boiler due to differences in density as the water is heated. Water circulation can occur without the need for a mechanical pump.

To the extent that explanations of certain terminology or principles of the boiler and/or steam generator arts may be necessary to understand the present disclosure, the reader is referred to *Steam/its generation and use,* 42nd Edition, edited by G. L. Tomei, Copyright 2015, The Babcock & Wilcox Company, ISBN 978-0-9634570-2-8, the text of which is hereby incorporated by reference as though fully set forth herein.

In a small boiler using only water-cooled furnace walls, it is difficult or impossible to achieve superheater and reheater outlet temperatures both at 1050° F. for 150-300 MW net power generation, because it is not possible to provide sufficient superheater/reheater surface area for heat transfer to the dry steam to obtain such high temperatures.

One possible alternative is to employ a drumless once-through boiler design, such as one of the Babcock & Wilcox Universal Pressure boiler designs. However, these designs employ once-through steam generation. In a once-through design, the transition point from wet steam to superheated steam depends on operating conditions, rather than being defined using a steam separator (e.g. a steam drum). As a result, more expensive piping is typically used for all piping/tubing in such once-through designs for safety. This results in increased capital costs.

In the sub-critical boiler designs of the present disclosure, the furnace is divided into two sections: a lower furnace using water-cooled membrane walls that feeds into the steam separator, and an upper furnace using steam-cooled membrane walls that is fed (directly or indirectly) by the dry steam outlet of the steam separator. This approach advantageously enables lower cost carbon steel to be used for the lower furnace walls, with more expensive piping being used only in the upper steam-cooled furnace (including the convection path walls in some embodiments). Cost is lowered by retaining the steam separator A higher steam output temperature is attainable because the use of a steam-cooled upper furnace and convection pass walls provides additional surface area for heat transfer from combustion/flue gases to the dry steam within the steam-cooled walls, resulting in superheated steam of desired temperatures. Again, such high superheated steam temperatures cannot be obtained with conventional water-cooled walls in the upper furnace.

In some embodiments, further improvement is attained in such a design by reducing the cross-section of the upper steam-cooled furnace compared with the lower water-cooled furnace. This increases flue gas flow velocity in the upper steam-cooled furnace compared with the lower water-cooled furnace, which provides more efficient heat transfer in the high temperature gas path, and also reduces the amount of materials and manufacturing cost.

In Carolina-Type Radiant Boiler designs, the convection pass is spaced apart from the furnace by a horizontal convection pass whose horizontal length creates a spacing between the furnace and the convection pass. As a result, in the Carolina-Type Radiant Boiler design, the furnace includes a rear wall and the convection pass includes a front wall. In a folded design, these two walls are combined into one wall. In the present disclosure, a common membraned steam-cooled wall is used to separate the upper furnace up-pass and the adjacent convection pass. This eliminates the open pass between the furnace and the convection pass, providing improved compactness for the boiler and reduces the amount of materials and manufacturing cost.

These benefits set forth above are attained by replacing the conventional water-cooled furnace with a two-part design in which the upper furnace is steam-cooled. However, such a modification has certain potential disadvantages. Overall material cost is increased due to the higher-cost alloys used in the upper furnace, but this can be mitigated by approaches disclosed herein (e.g., reduced upper furnace cross-section, employing a common steam-cooled wall between the furnace and the convection pass). Another potential disadvantage is structural complications for the preferred top-supported arrangement. This potentially arises because the lower furnace pipes are preferably carbon steel to reduce cost, while the upper furnace pipes are higher cost alloys for compatibility with steam cooling. Such a difficulty is also encountered in some once-through super-critical furnaces that employ carbon steel pipes in a lower furnace section to reduce cost. An example of such a design is the Babcock & Wilcox Spiral Wound Universal Pressure (SWUP) Boiler. In the SWUP once-through super-critical boiler design, the lower water-cooled furnace portion is top-supported via dedicated lower furnace support components that connect with the upper boiler support via an array of vertical tie rods and/or connections to the upper furnace water-cooled pipes. The resulting assembly is complicated as the lower furnace must be secured by installing its support components, followed by performing the pipe welding.

Such an approach employing dedicated lower furnace support components can also be employed in sub-critical boiler designs with an upper steam-cooled furnace and lower water-cooled furnace, as disclosed herein. However, in some embodiments disclosed herein, such dedicated support castings and concomitant complex pipe welding operations are eliminated, and in their place a transition section with integral transition piping is employed. The transition section contains both water pipes and steam pipes, and provides a location where these pipes can be run to headers. In the transition section, at least some transition pipes are designed to be vertically oriented pipes, and lower furnace support is achieved by tensile support via welds to these vertically oriented transition pipes. The transition section can be made of a high alloy steel material that is compatible with steam-cooling—it is therefore overdesigned for the water-cooled transition pipes, but the ability to maintain top support for the lower furnace outweighs the additional cost entailed by overdesigning these relatively short water-cooled transition pipes. The transition section also acts as a pressure seal between the furnace and the atmosphere.

Some illustrative embodiments of such sub-critical boilers are diagrammatically shown and described below. These are merely illustrative examples, and a given embodiment may include one, two, more, or all disclosed novel features described herein.

Figure 2:
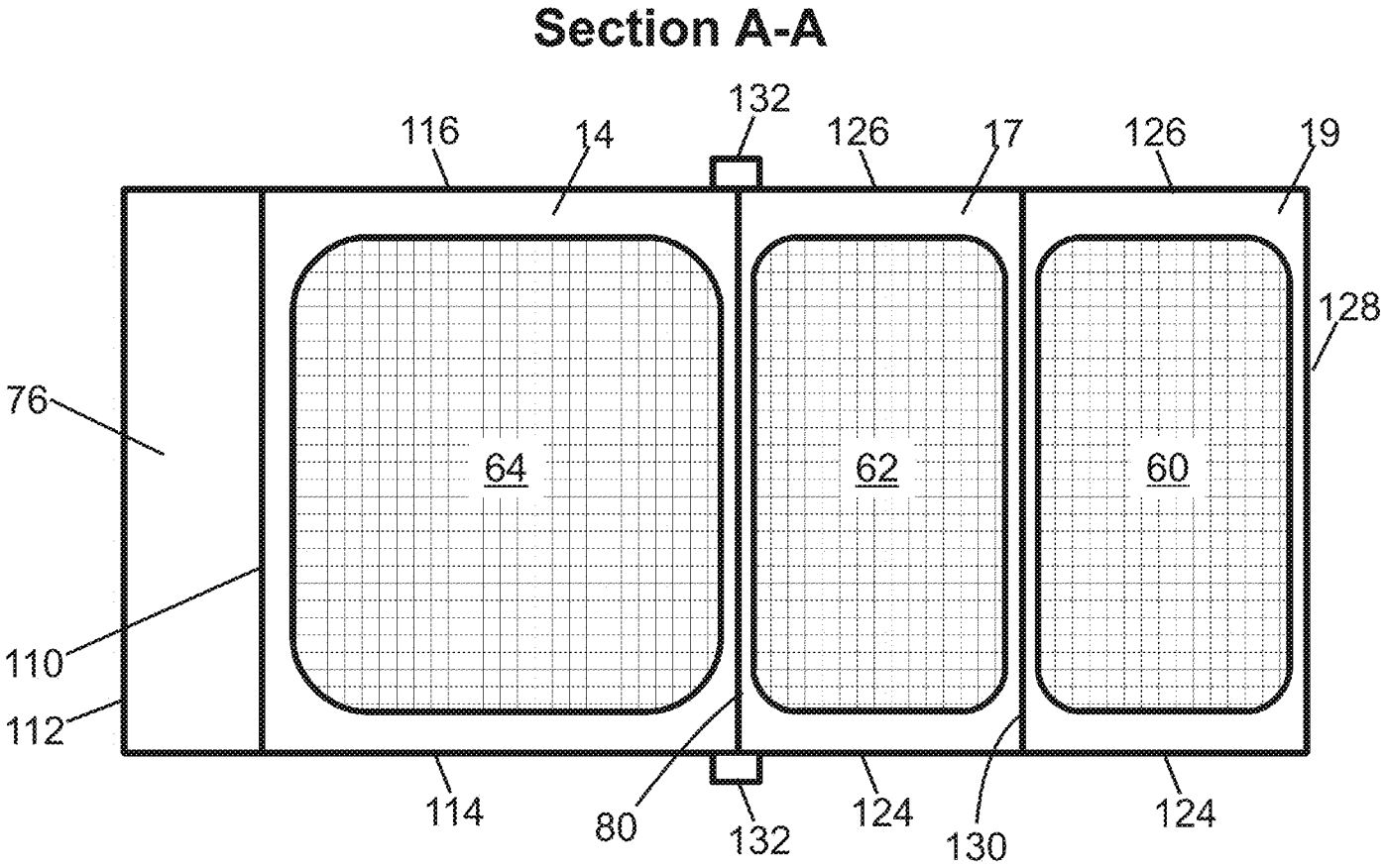
FIG. 2 is a top cross-sectional view of the boiler of FIG. 1 through the upper furnace along line A-A of FIG. 3.

FIG. 1 and FIG. 2 show different views of an illustrative sub-critical natural circulation boiler of the present disclosure. FIG. 1 is a side-sectional view of the entire boiler. FIG. 2 is a top (plan) view that passes through the upper furnace of the boiler.

With reference to FIG. 1, a sub-critical boiler 10 is diagrammatically shown. The boiler 10 includes a lower furnace 12 which is water-cooled, an upper furnace 14 which is steam-cooled, and a transitional section 16 which in preferred embodiments is formed from a single-piece transition casting. The illustrative boiler 10 is a folded boiler design that further includes a convection pass 18 which is connected to the upper furnace 14 to form what might be considered a horizontal pass 20. The walls of the lower furnace 12, the transitional section 16, the upper furnace 14, and the convection pass 18 collectively define the boiler.

Combustion/flue gas 22 are diagrammatically indicated by arrows, and these gases flow through the boiler and heat the water/steam in the various walls of the boiler. More specifically, combustion air is blown into the lower furnace 12 through an air inlet 24, where it is mixed with a combustible fuel such as coal, oil, or natural gas. In some preferred embodiments, the fuel is coal, which is pulverized by a pulverizer (not shown). A plurality of burners 26 combusts the fuel/air mixture, resulting in flue gas. The flue gas rises by natural convection through the up-pass formed by the lower furnace 12, the transition section 16, and the upper furnace 14, then flows horizontally through the convection pass, which includes the convection pass 18 and finally exits through a flue gas outlet 28 for further downstream processing. Preferably, a hopper 33 is provided to capture ash or other contaminants in the exiting flue gas.

The sub-critical boiler 10 is top-supported to the building structure via suitable upper anchor points 30. These are diagrammatically indicated in FIG. 1. The pipes of the upper furnace 14 and the convection pass 18 are vertically oriented and are directly supported from the anchor points 30. The pipes of the lower furnace 12 are also vertically oriented and are directly supported via welds to the transition section 16.

It is desirable to capture the heat energy present in the combustion/flue gas 22 for tasks such as driving an electrical power generation turbine (for example). To do so, the sub-critical boiler 10 includes cooling surfaces comprising pipes or tubes through which wet steam flows (these pipes or tubes are referred to herein as water-cooled) or through which superheated steam flows (these pipes or tubes are referred to herein as steam-cooled). More particularly, with reference to Inset A of FIG. 1, the lower furnace 12 includes water-cooled tubes 32 with membrane 34 disposed between and welded to the tubes 32, so that the tubes 32 and membrane 34 collectively form a membrane wall 36, with the tubes 32 carrying flow of wet steam through the membrane wall 36. The membrane wall 36 forms the barrier that contains the flue gas 22, i.e. the membrane 34 is welded or otherwise connected to the tubes 32 to provide a seal against leakage of the flue gas 22. The water-cooled membrane wall 36 of the lower furnace 12 does not see highly elevated water temperatures; for example, if the sub-critical boiler 10 is designed for a maximum steam pressure of 2800 psig, then the saturated steam carried by the water-cooled tubes 32 is at about 685° F. (corresponding to the boiling point of water at 2800 psig), though of course the combustion gas is at a much higher temperature.

The upper furnace 14 and convection pass 18 are analogously made of a steam-cooled membrane wall 46 comprising steam-cooled tubes 42 with membrane 44 disposed between and welded or otherwise connected to the tubes 42 (see Inset B of FIG. 1), with the tubes 42 and membrane 44 collectively forming the membrane wall 46. The tubes 42 carry a flow of superheated steam through the membrane wall 46. The steam-cooled membrane wall 46 carries steam at substantially higher steam temperature than the water-cooled membrane wall 36. For example, the steam in the steam-cooled membrane walls 46 may be at a temperature of over 1000° F., e.g. up to 1100° F. in some contemplated embodiments. It should be noted that the roof 35 of the furnace and the convection pass is also made of steam-cooled membrane wall. It should also be noted that the diameter of the tubes and the spacing between the tubes of the steam-cooled membrane walls may differ between the upper furnace and the convection pass.

The tubes 32 of the water-cooled membrane wall generally have a greater diameter than the tubes 42 of the steam-cooled membrane wall. In particular, embodiments, the inner diameter of the water-cooled tubes is at least 0.5 inches greater than the inner diameter of the steam-cooled tubes. The tubes of the water-cooled membrane wall have an inner diameter of about 1.5 inches to about 2.0 inches, while the tubes of the steam-cooled membrane wall have an inner diameter of about 1.0 inches to about 2.5 inches. The tubes of the water-cooled membrane wall have an outer diameter of about 2.0 inches to about 2.5 inches, while the tubes of the steam-cooled membrane wall have an outer diameter of about 1.3 inches to about 2.3 inches. The tubes themselves may have a thickness of about 0.2 inches to about 0.5 inches.

In a typical steam flow circuit for the sub-critical boiler 10, water is inputted to the lower ends of the water-cooled tubes 32 via a lower inlet header 50. As the water travels upwards through these water-cooled tubes 32, the water cools the tubes exposed to high-temperature flue gas in the lower furnace 12 and absorbs energy from the flue gas to become a steam-water mixture (i.e. wet steam) at subcritical pressure.

The wet steam exits the upper ends of the water-cooled tubes 32 and flows via a wet steam outlet header 52 into an inlet 53 of a steam separator 54. The wet steam outlet header 52 is preferably welded to water-cooled transition pipes within the transition section 16. Preferably, the wet steam outlet header 52 facilitates venting of the tubes 32 as appropriate during start up, shut down, or maintenance, etc. Any type of steam separator may be used, e.g. employing cyclonic separation or so forth. In particular embodiments, a vertical steam separator is used, such as that described in U.S. Pat. No. 6,336,429. A dry steam outlet 56 of the steam separator 54 at an upper end of the steam separator outputs substantially dry steam (i.e., steam with 100% quality). A drain or water outlet 58 near the lower end of the steam separator 54 collects water extracted from the wet steam for recycle back to the lower inlet header 50 feeding the lower furnace 12.

The steam output from the dry steam outlet 56 flows to the convection pass 18 and then to the upper furnace 14. To provide additional surface for heat transfer, one or more primary superheaters 60, re-heaters 62, and/or secondary superheaters 64 may be provided in the interior volume of the boiler, within the upper furnace 14 and the convection pass 18. As illustrated here, one or more superheaters 60 disposed in the convection pass 18; one or more re-heaters (or re-heating superheaters) 62 are disposed in the convection pass 18 and/or in the upper furnace 14; and one or more secondary superheaters 64 are disposed in the upper furnace 14. Again, the steam-cooled furnace walls 46 of the upper furnace 14 act as superheater surfaces as well. A more detailed illustrative steam circuit is described in later drawings. It is to be understood that the illustrative steam circuit is merely an example, and other steam circuit configurations are contemplated, e.g. various superheater components may be omitted, and/or located elsewhere, etc.

Unlike the membrane walls 46 of the steam-cooled upper furnace 14 and the convection pass 18, the superheaters 60, 62, 64 located within the boiler are formed from loose pipes/tubes 72 without membranes joining the tubes together (see Inset C of FIG. 1). These superheaters 60, 62, 64 are disposed in the interior of the flue boiler, and desirably permit flue gas to pass through them, increasing the surface area through which heat transfer from the flue gas to the steam within the pipes can occur. The superheater pipes 72 are preferably made of an alloy steel material. In some embodiments, the superheater pipes 72 and the steam-cooled membrane wall 46 are made of the same alloy steel material, although this is not required.

As seen in FIG. 1, the superheaters 60, 62, 64 are surrounded by the steam-cooled membrane walls 46. Said another way, the superheaters 60, 62, 64 are contained within the upper furnace 14 and/or in the convection pass 18 as shown in the illustrative boiler 10 of FIG. 1. The steam within the steam-cooled membrane walls 46 may be at the same or higher temperature than in the superheaters 60, 62, 64. Due to the additional surface area available for heat transfer from the flue gas to the superheated steam within the various superheating surfaces 46, 60, 62, 64, the boiler 10 can achieve higher superheated steam temperatures than would be achievable with a conventional water-cooled sub-critical boiler whose furnace walls are entirely cooled by wet steam flowing through water-cooled pipes. However, the sub-critical boiler 10 retains the general layout of a sub-critical boiler, including employing the steam separator 54 disposed (in a steam flow sense) between the wet steam sub-circuit and the superheated steam sub-circuit, thus retaining advantages such as the operational flexibility of a sub-critical boiler design.

The illustrative sub-critical boiler 10 employs certain features that enhance compactness and efficiency. One feature is a reduced cross-sectional area for the combustion/flue gas flow 22 through the upper furnace 14 compared with the lower furnace 12. The referenced cross-sectional area is the horizontal cross-section in the illustrative design in which the flue gas 22 flows vertically upward. In the illustrative boiler 10, the reduction in cross-sectional area of the upper furnace 14 relative to the lower furnace 12 is obtained via a "arch" surface 76, which is slanted as the upper furnace continues upward from the transition section 16, to reduce turbulence at the transition to higher flow velocity. This has at least two benefits. First, the reduced cross-sectional area of the upper furnace 14 reduces the amount of material (e.g. total surface area of membrane wall 46) which reduces capital cost. Second, the higher velocity of the flue gas flow 22 due to the reduced cross-sectional area increases the efficiency of heat transfer to the steam-cooled pipes 42, 72. The transition section 16 is located below the arch 76. The arch 76 is part of the upper furnace, and is also a steam-cooled membrane wall.

FIG. 2 is a cross-sectional plan (top) view of the boiler 10 through the upper furnace 14, and provides another view of the various components. The front wall 110 of the upper furnace is shown in solid line, as is the front wall 112 of the lower furnace. The area between these two walls is the arch 76. The upper furnace includes a first side wall 114 and a second side wall 116 opposite the first side wall, both of which are made of steam-cooled membrane walls 42. The fourth side of the upper furnace is defined by a common steam-cooled membrane wall 80. The convection pass is defined by a first side wall 124, a second side wall 126 opposite the first side wall, and a rear wall 128. A baffle wall 130 divides the convection pass into a front convection pass 17 and a rear convection pass 19. A primary superheater 60 is seen in the rear convection pass 19, while a reheater 62 is seen in the front convection pass 17 and a secondary superheater 64 is seen within the upper furnace 14.

Another feature that enhances the compactness and efficiency of this boiler design is the use of a common steam-cooled membrane wall 80. The common steam-cooled membrane wall 80 is both a "rear" wall of the upper furnace 14 and a "front" wall of the convection pass 18. The upper furnace 14 and the convection pass 18 thus share the common steam-cooled membrane wall 80, which comprises a single layer of pipes sealed by a single layer of membrane disposed between and connected to the single layer of pipes. The use of the common steam-cooled membrane wall 80 has numerous advantages. The usual open pass between the furnace and the convection pass is eliminated, providing a more compact design and reducing capital costs due to lower surface area. The common steam-cooled membrane wall 80 is advantageously heated both by flue gas flowing upward through the upper furnace 14 and by flue gas flowing downward through the convection pass 18.

One issue with employing the common steam-cooled membrane wall 80 is the large temperature variation between the flue gas temperature in the upper furnace 14, on the one hand, and the flue gas temperature in the convection pass 18 on the other hand. This differential between the two flue gas temperatures will be felt by the common steam-cooled membrane wall 80. Using transient modeling and finite element analysis to determine the resulting stress in the walls of the boiler, it was found that maximum thermal differential stress occurs during start-up, and more particularly occurs in a small area about the bottom of the common steam-cooled membrane wall 80 adjacent walls 114, 124 on one side and walls 116, 126 on the other. Intuitively, this can be understood since this bottommost part of the common steam-cooled membrane wall 80 is where there is the greatest temperature differential between the upward flue gas flow in the upper furnace 14 and the downward flue gas flow in the convection pass 18. This stress can cause boiler bowing/tearing, and is accommodated by providing seals at the junction of the bottom of the common steam-cooled membrane wall 80, the furnace side walls 114, 116, and the convection pass side walls 124, 126, as analysis showed that the overstressed area does not extend significantly up the common steam-cooled membrane wall 80. These seals are illustrated in FIG. 2 with reference numeral 132.

It should be noted that the various improvements disclosed herein can be used to advantage individually or in various combinations, and/or in various types of boilers. For example, the disclosed common steam-cooled membrane wall 80 can also be used to advantage in a once-through boiler design having a convection pass, or in other types of boilers having two neighboring steam-cooled membrane walls.

Figure 3:
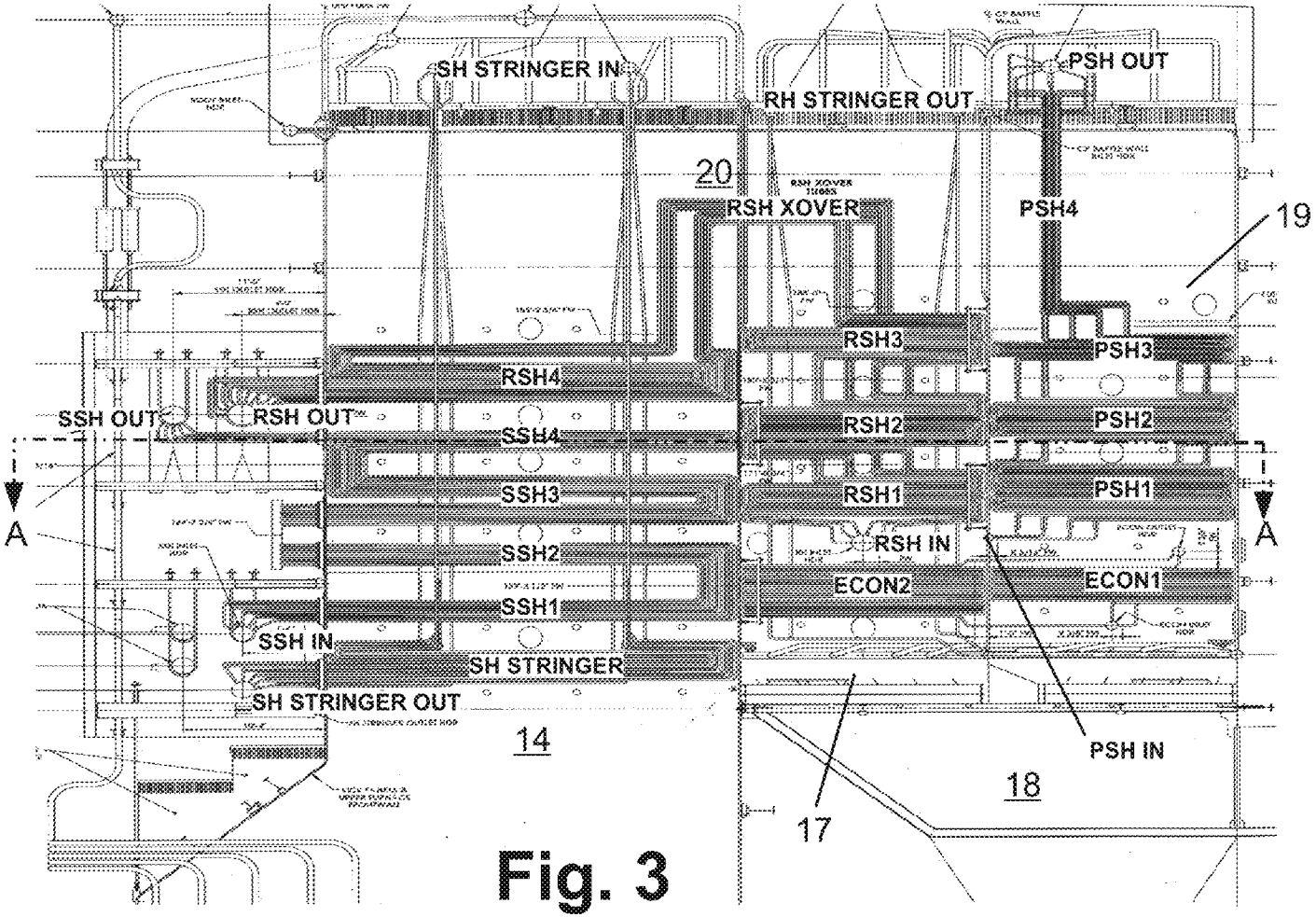
FIG. 3 diagrammatically shows a more detailed side-sectional view of a portion of the boiler of FIG. 1 including an illustrative layout of superheaters.
Figure 4:
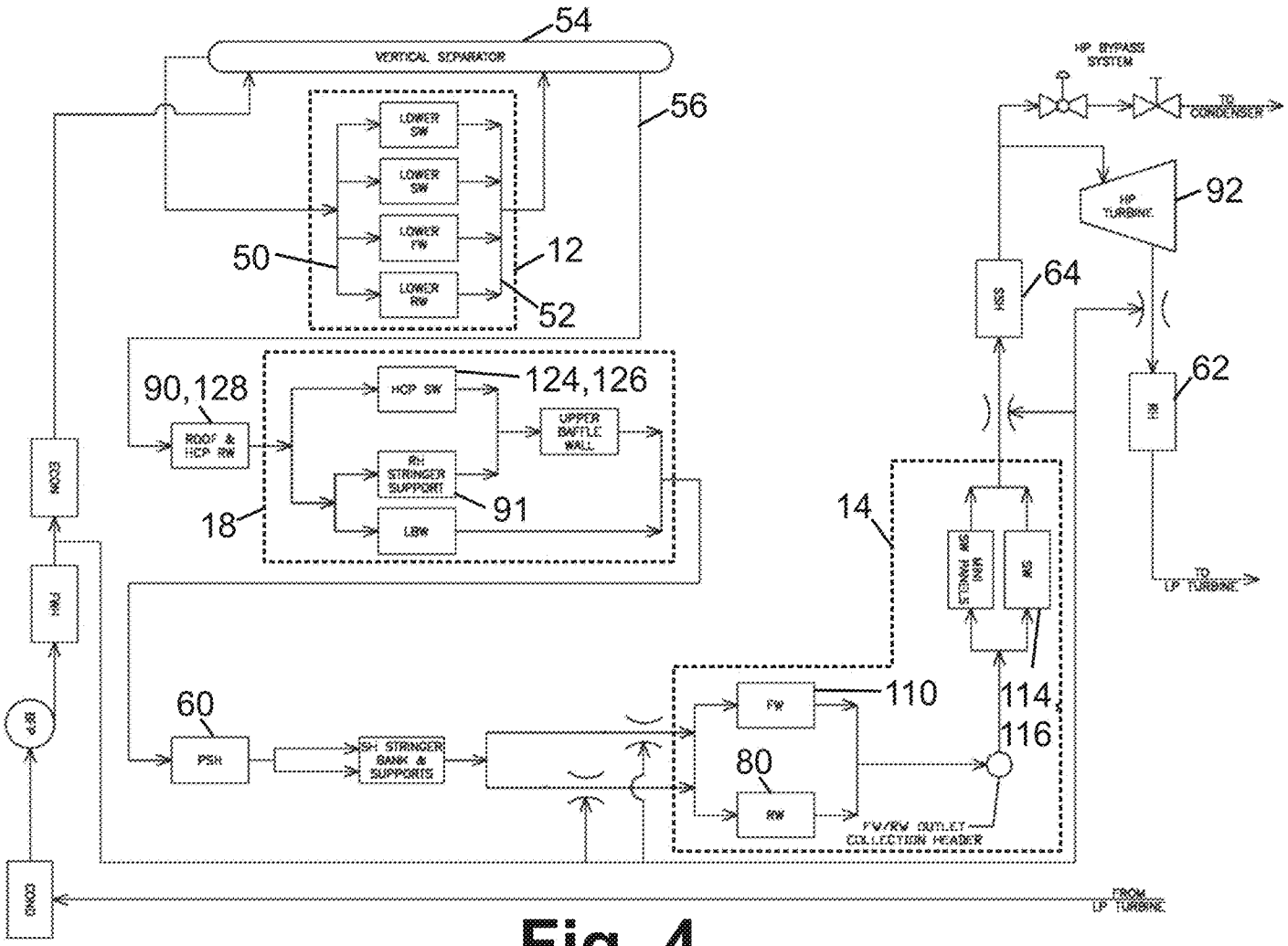
FIG. 4 diagrammatically shows a cooling circuit of the boiler of FIG. 1 and FIG. 2.

With reference now to FIGS. 2-4, an illustrative steam-cooled circuit is described that may be used in the boiler 10 of FIG. 1. FIG. 3 shows a side-sectional view of the upper furnace 14, the convection pass 18, and the horizontal pass 20 connecting them. Also shown are more detailed renderings of the primary superheaters 60, reheaters 62, and secondary superheaters 64. In FIG. 3 and FIG. 4, the primary superheaters 60 are labeled using the prefix "PSH"; the reheaters (i.e. re-heating superheaters) are labeled using the prefix "RSH"; and the secondary superheaters are labeled using the prefix "SSH". Additionally, economizers are shown, indicated by the prefix "ECON". Inlet headers are indicated by the suffix "IN" while outlet headers are indicated by the suffix "OUT".

As shown in FIG. 3, there are four primary superheaters disposed in the rear convection pass 19. Three of these employ horizontal tubes, and from lowest to highest elevation are indicated as PSH1, PSH2, and PSH3. The fourth primary superheater PSH4 is at the highest elevation and employs vertical pipes. Flow through the primary superheaters is in sequential order by number, upward through the convection pass, and the superheated steam exits at the PSH OUT header at the roof of the boiler.

Four reheaters RSH1, RSH2, RSH3, and RSH4 are also employed. Three of these (RSH1, RSH2, and RSH3) are disposed in the front convection pass 17, while the fourth reheater RSH4 is disposed near the top of the upper furnace 14. Cross-over piping labeled RSH XOVER conveys steam from RSH3 in the convection pass 18 to RSH4 in the upper furnace 14. Steam flow is from a lower inlet header RSH IN, through the reheaters in sequential order, to an outlet header RSH OUT shown to the left of the upper furnace 14 in FIG. 3.

Four secondary superheaters SSH1, SSH2, SSH3, and SSH4 are disposed in the upper furnace 14 below the fourth re-heater RSH4. Superheated steam flows from the PSH OUT header to the SSH IN header shown to the left of the upper furnace 14, then upwards successively through SSH1, SSH2, SSH3, and SSH4 and to the SSH OUT header again shown to the left of the upper furnace 14 above the SSH IN header.

The steam-cooled circuit further includes superheater stringers denoted SH STRINGER in FIG. 3, which are fed from SH STRINGER IN headers at the top of the upper furnace and subsequently flow to the SH STRINGER OUT outlet header. These stringers support the secondary superheaters. Similarly, reheater stringers are visible which support the reheaters in the front convection pass.

Referring now to FIG. 4, a more detailed illustration of the components that form the steam-cooled circuit and their interconnections is shown. The steam-cooled circuit starts at the dry steam outlet 56 of the steam separator 54. Going downstream from the steam separator, dry steam running downstream first flows from the dry steam outlet 56 across the roof 90 of the boiler 10. Dry steam also flows down the rear wall 128 of the convection pass 18. The dry steam that flowed down the rear wall 128 then flows up the convection pass side walls 124, 126 and the reheater stringer supports 91, and then back down the upper baffle wall. The dry steam from the roof 90 of the boiler flows up the lower baffle wall.

The two dry superheated steam streams from the upper baffle wall and the lower baffle wall are then combined and flow into the primary superheaters 60 (i.e. PSH1, PSH2, PSH3, PSH4 in FIG. 3). Please note the superheated steam travels through all four primary superheaters; the steam is not divided so that only a portion flows through each primary superheater. The superheated steam travels upwards to the PSH OUT header (see FIG. 3). The superheated steam then travels downwards through the superheater stringers (labeled SH STRINGER) in the upper furnace. From there, the superheated steam travels upwards through the upper furnace front wall 110 and the common steam-cooled membrane wall 80 (acting as the upper furnace rear wall). The superheated steam then travels upwards through the upper furnace side walls 114, 116. Next, the superheated steam travels upwards through the secondary superheaters 64. Again, the superheated steam passes through all four secondary superheaters (SSH1, SSH2, SSH3, and SSH4). After passing through the secondary superheaters, the superheated steam has a pressure of 2000 psig or greater, and in some cases 2500 psig or greater, such as about 2600 psig. The superheated steam also has a temperature of 1000° F. or greater, such as about 1050° F. The superheated steam is then sent to a high-pressure turbine 92 where the heat energy is used for electrical power generation. The superheated steam loses both temperature and pressure within the high-pressure turbine 92. The output from the high-pressure turbine is then sent back to the boiler 10 and sent through the reheaters 62. After passing through the reheaters, the steam has a pressure of 500 psig or greater, such as about 600 psig, and also has a temperature of 1000° F. or greater, such as about 1050° F. This superheated steam can then be used to run a low-pressure turbine.

Referring back to FIG. 4, water is returned from the low-pressure turbine. This water passes through a condenser (COND), a boiler feed pump (BFP), and a feedwater heater (FWH) before being sent to the economizer (ECON) to absorb residual heat energy from the flue gas exiting the convection pass. From there, the heated water from the economizer is sent to the steam separator 54. In the water-cooled circuit, water is sent from the steam separator to lower furnace inlet header 50, which feeds the water-cooled membrane walls of the lower furnace 12. Wet steam is collected from lower furnace outlet header 52 and sent to the steam separator 54 for separation into water and dry steam.

The steam-cooled circuit of FIG. 3 and FIG. 4 is merely an illustrative example, and in other embodiments the number and locations of superheaters may be different, as well as the arrangement of the various steam-cooled membrane wall and superheater components in the steam-cooled circuit. The illustrative furnace of FIG. 1 with the illustrative steam-cooled steam circuit of FIG. 3 and FIG. 4 has been modeled using 3D solid modeling software, and was determined from analysis thereof to provide improved performance including a 1050° F./2600 psig superheater temperature/pressure and a 1050° F./600 psig reheater temperature/pressure, for a boiler designed to provide 150 MW to 300 MW of net power.

Referring back now to FIG. 1, the transition section 16 connects the lower furnace 12 to the upper furnace 14. As previously mentioned, this allows the lower furnace to be top-supported through the transition section and the upper furnace. It should be noted that the transition section is relatively short. The transition section is only about 4 feet in total height.

Figure 5:
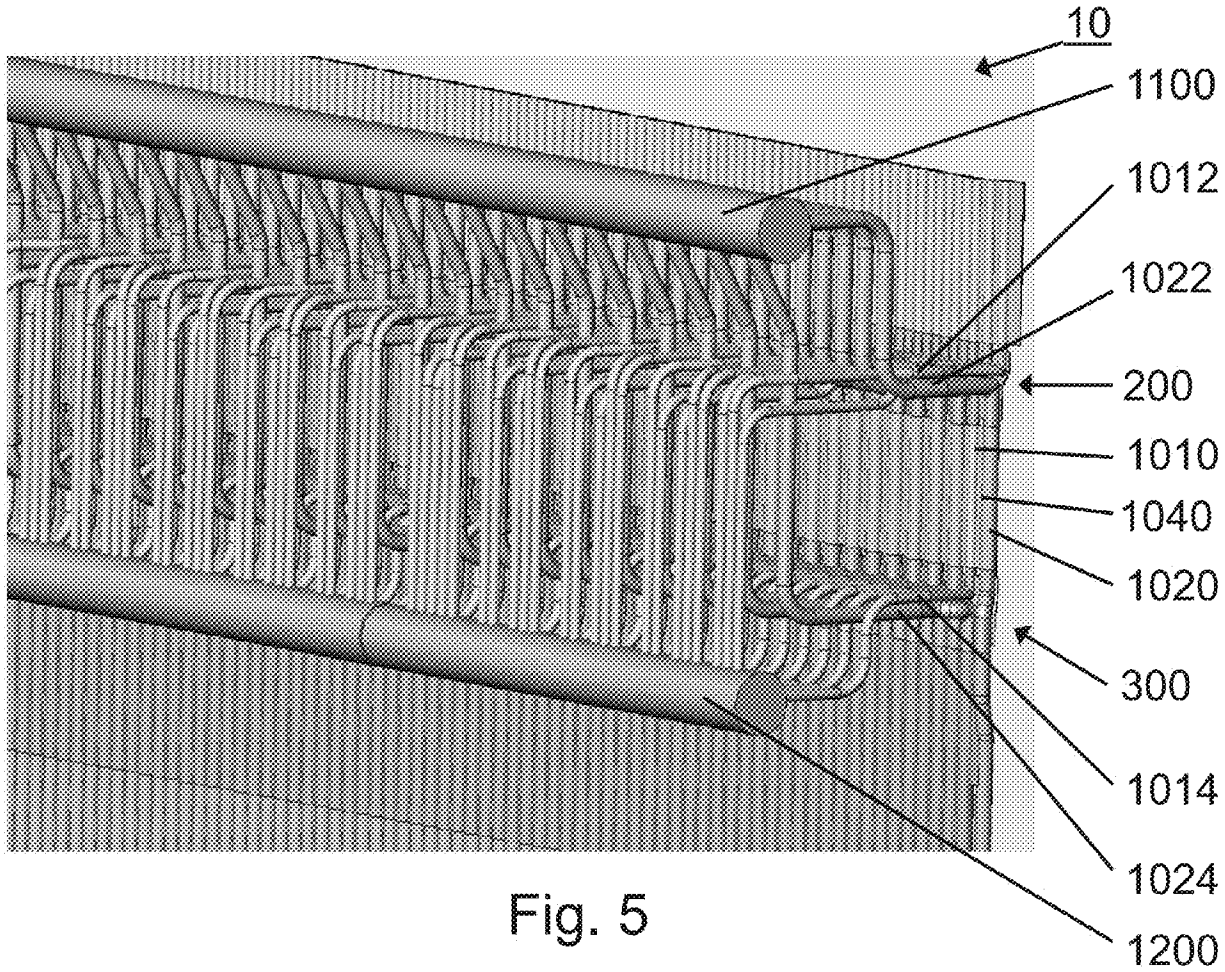
FIG. 5 is a magnified perspective view of the boiler showing the transition section.

FIG. 5 is a magnified perspective view of the boiler showing the transition section 16. The transition section is made up of upper transition castings 200 and lower transition castings 300. As will be explained in greater detail further herein, each transition casting 200, 300 includes bent steam tubes and bent water tubes. Dry/superheated steam flows through the bent steam tubes, and water or a water/steam mixture) flows through the bent water tubes. As can be seen, this arrangement permits steam cooled tubes to drain and water cooled tubes to be vented during start up.

The tubes of the upper transition castings 200 and lower transition castings 300 are fluidly joined to each other through straight steam tubes 1010 and straight water tubes 1020 which are joined together via membrane 1040 to create a pressure seal. A steam inlet header 1200 is present outside the pressure boundary (i.e. on the exterior of the furnace), and is located below the lower transition casting 300. A water outlet header 1100 is also located outside of the pressure boundary, and is located above the upper transition casting 200. Steam-cooled tube 1012 connects the upper transition casting 200 to the steam inlet header 1200. Steam-cooled tube 1014 connects the lower transition casting 300 to the steam inlet header 1200. Water-cooled tube 1022 connects the upper transition casting 200 to the water outlet header 1100. Water-cooled tube 1024 connects the lower transition casting 300 to the water outlet header 1100.

Figure 6:
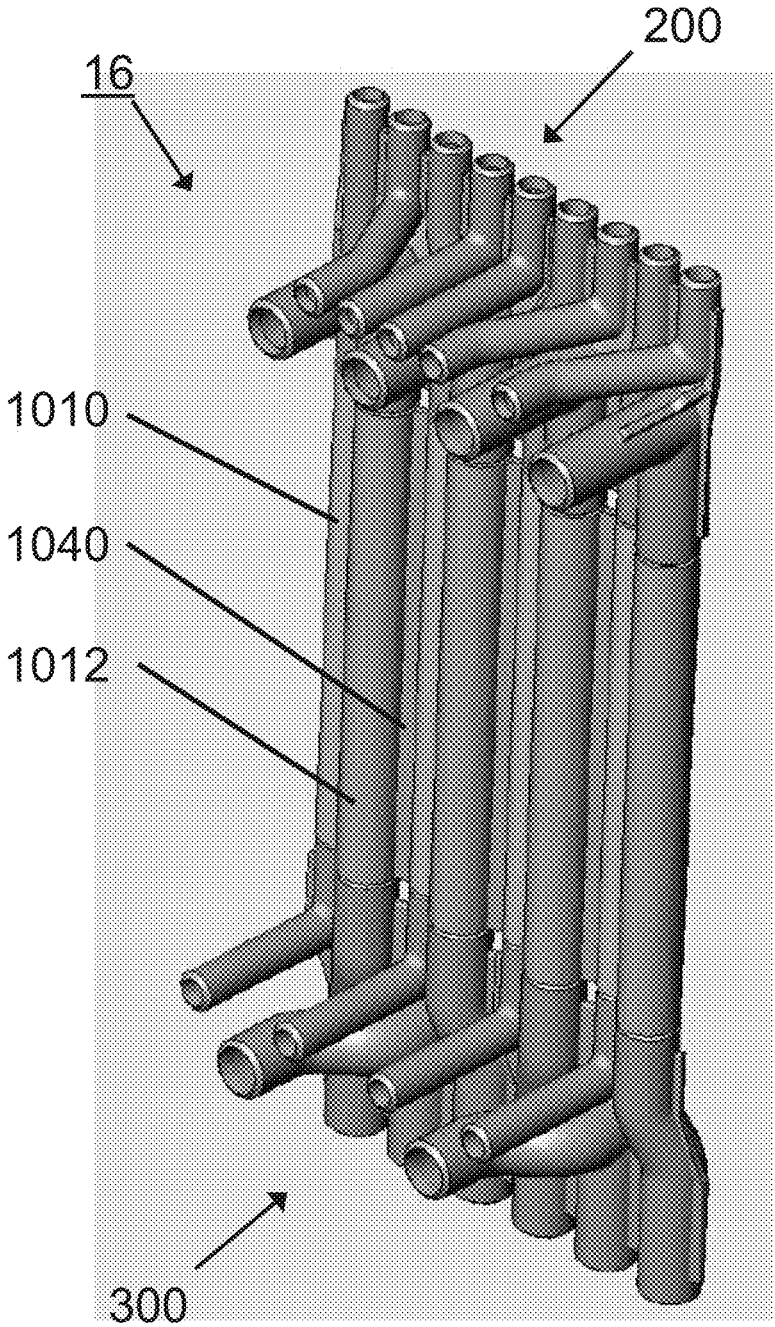
FIG. 6 is a perspective view of the transition section.

FIG. 6 is a perspective view of the transition section 16 only. The upper transition casting 200 and the lower transition casting 300 are more easily visible here. As more easily seen here, the straight steam tubes 1010 and the straight water tubes 1020 are joined together by membrane 1040. Going laterally, the straight steam tubes 1010 alternate regularly with the straight water tubes 1020 (i.e. steam tube, water tube, steam tube, water tube, etc.). However, the straight steam tubes 1010 and the straight water tubes 1020 are also arranged in different planes, with the membrane being angled to join the tubes together.

Figure 7:
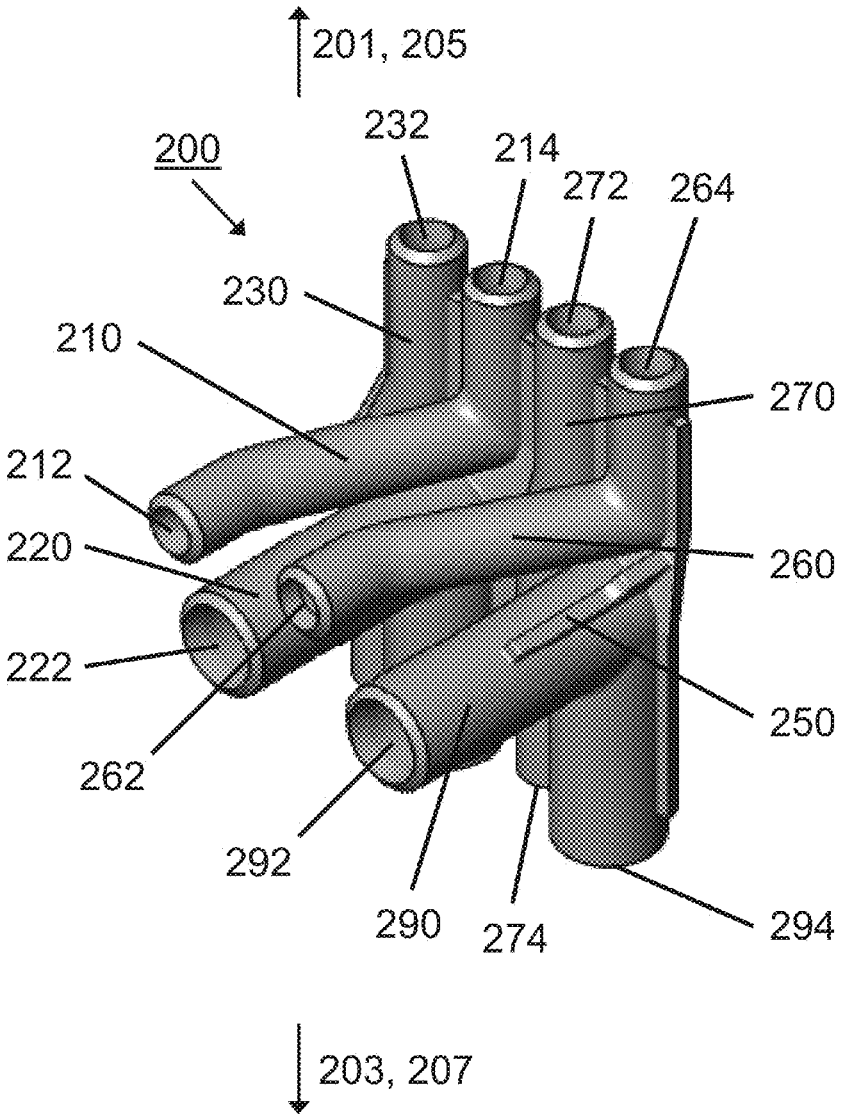
FIGS. 7-10 are different views of an upper transition casting.
Figure 8:
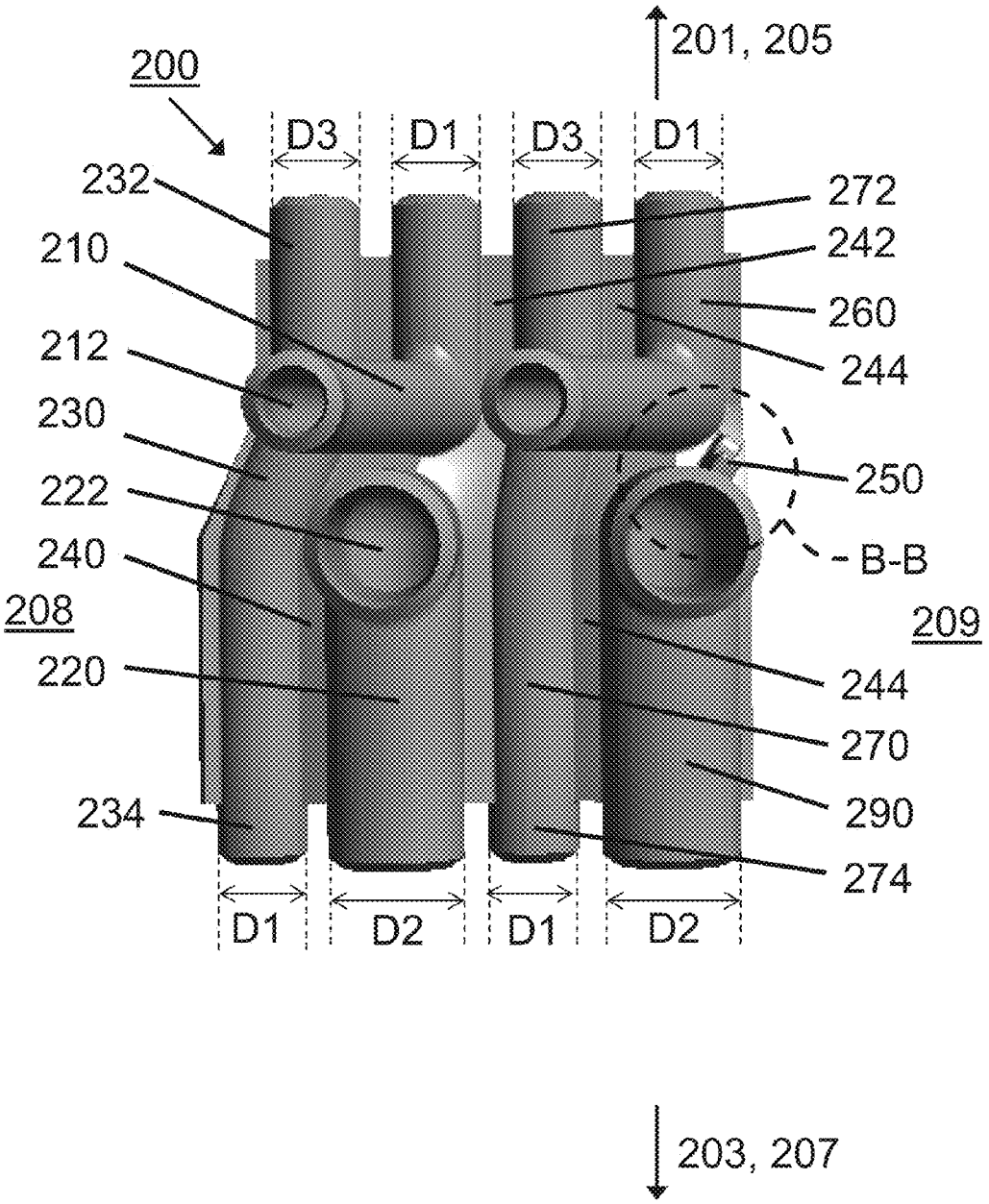
Figure 9:
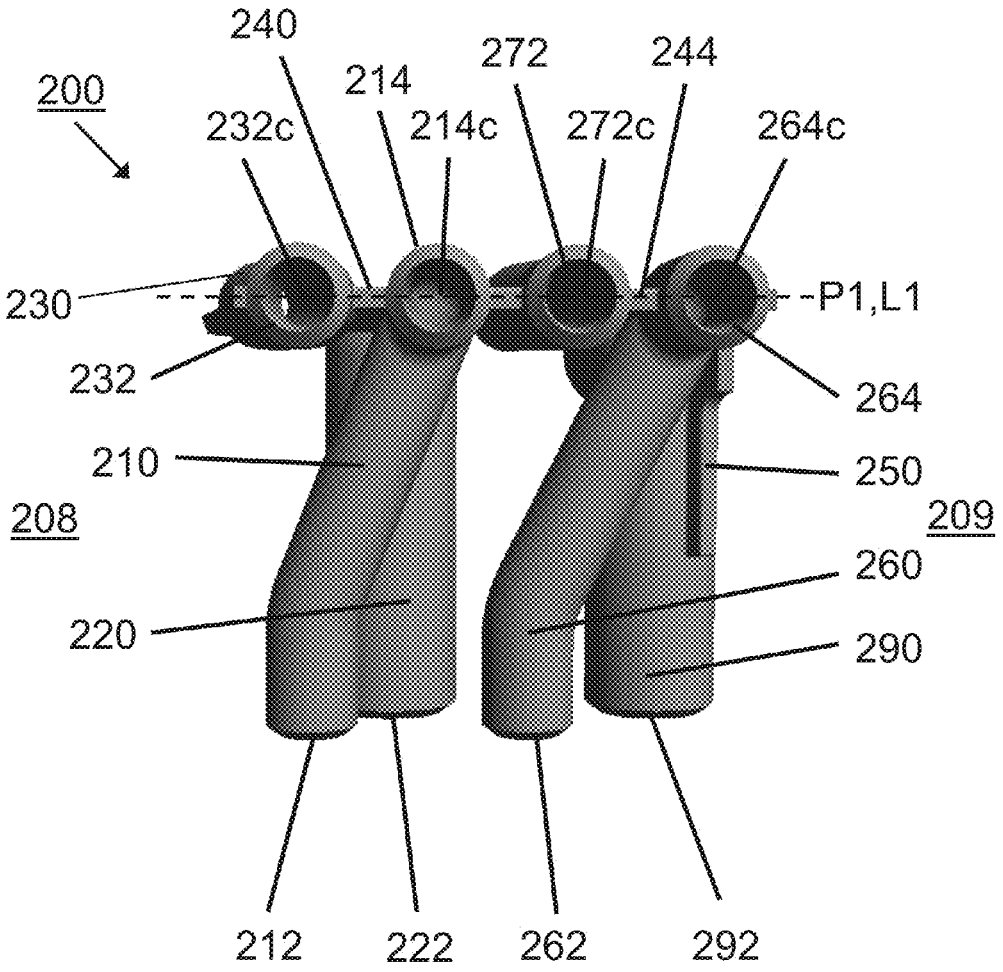
Figure 10:
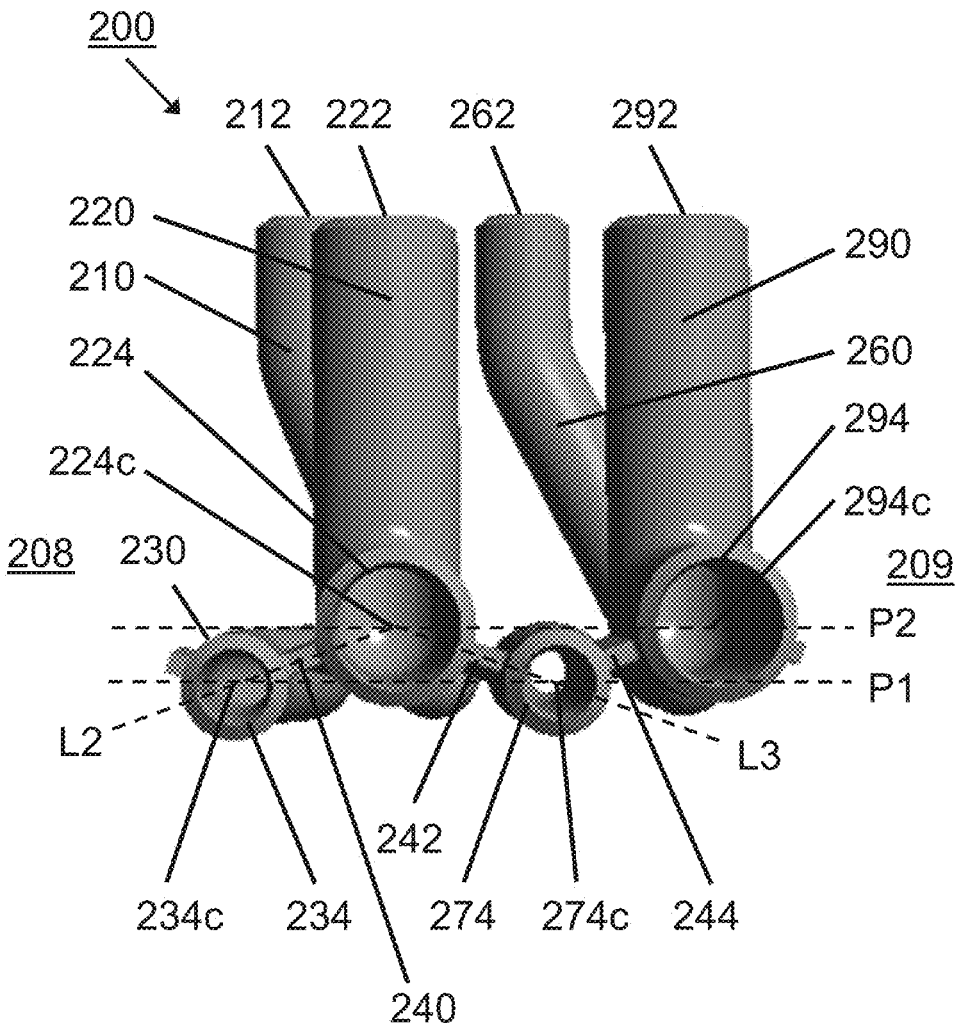

FIGS. 7-10 are different views of the upper transition casting 200. FIG. 7 is a perspective view. FIG. 8 is a front view. FIG. 9 is a top view, and FIG. 10 is a bottom view. The various components of the upper transition casting will now be described below. These figures include arrows indicating a first vertical direction 201, a second vertical direction 203 opposite the first vertical direction, a first lateral direction 208 which is perpendicular to the first vertical direction 201, and a second lateral direction 209 which is opposite the first lateral direction.

Referring now to FIGS. 7-10, the upper transition casting 200 is broadly defined by a first steam tube 210, a first water tube 220, a first pass-through tube 230, and membrane 240 that joins these three tubes 210, 220, 230 together to form a pressure seal. The first steam tube 210 has a steam passageway extending between a front end 212 pointing in the forward direction (i.e. outwardly from the furnace) and a vertical end 214 pointing in a first vertical direction 201, which in this case is also an upper vertical direction 205. The first water tube 220 has a water passageway extending between a front end 222 that also points in the forward direction and a vertical end 224 pointing in a second vertical direction 203. The second vertical direction 203 is opposite that of the first vertical direction 201, and in this case is also a lower vertical direction 207. The first pass-through tube 230 has a fluid conduit extending between a first vertical end 232 that points in the first vertical direction 201 and a second vertical end 234 that points in the second vertical direction 203. It is noted that the first steam tube 210 and the first water tube 220 do not cross over (i.e. extend past) each other at the middle of the transition casting. Put another way, the front end 212 of the first steam tube is closer to the vertical end 214 of the first steam tube than the front end 222 of the first water tube is. Also, the front end 222 of the first water tube is closer to the vertical end 224 of the first water tube than the front end 212 of the first steam tube is.

The upper transition casting 200 may also have additional steam tubes, water tubes, and pass-through tubes. Here, the upper transition casting also has a second steam tube 260, a second pass-through tube 270, and a second water tube 290. The second steam tube 260 also has a steam passageway extending between a front end 262 pointing in the forward direction and a vertical end 264 pointing in the first vertical direction 201. The second water tube 290 also has a water passageway extending between a front end 292 that also points in the forward direction and a vertical end 294 pointing in a second vertical direction 203. The second pass-through tube 270 has a fluid conduit extending between a first vertical end 272 that points in the first vertical direction 201 and a second vertical end 274 that points in the second vertical direction 203. Membrane 242 joins the first steam tube 210, first water tube 220, and the second pass-through tube 270 together to form a pressure seal. Membrane 244 joins the second steam tube 260, second water tube 290, and the second pass-through tube 270 together to form a pressure seal.

As seen particularly in FIG. 8, the first steam tube 210 and the first water tube 220 are located vertically relative to each other (i.e. one above the other). The first steam tube 210 and the first water tube 220 are both adjacent to a common side of the first pass-through tube 230 (i.e. the first lateral side). The first steam tube 210 and the first water tube 220 are also located between the first pass-through tube 230 and the second pass-through tube 270.

The front end 212 of the first steam tube 210 is laterally offset from the front end 222 of the first water tube 220, i.e. the center of the first steam tube is off to one side of the center of the first water tube. The front end 212 of the first steam tube 210 is also vertically offset from the front end 222 of the first water tube 220, i.e. they are at different heights. Relative to itself, the front end 212 of the first steam tube 210 is laterally offset from the vertical end 214 of the first steam tube 210, i.e. to one side. In contrast, the front end 222 and the vertical end 224 of the first water tube 220 are vertically aligned with each other.

As seen in FIG. 8, the first steam tube 210 has a steam tube diameter D1. The first water tube 220 has a water tube diameter D2. The first pass-through tube 230 has a pass-through tube diameter D3. Depending on whether the pass-through tube transports water or steam, the pass-through tube diameter D3 may be equal to either D1 or D2. Here, the diameter D3 is equal to D1. Generally, the water tube diameter D2 will be greater than the steam tube diameter D1. As previously discussed above, in particular, embodiments, the inner diameter of the water tubes is at least 0.5 inches greater than the inner diameter of the steam tubes. The water tubes have an inner diameter of about 1.5 inches to about 2.0 inches, while the steam tubes have an inner diameter of about 1.0 inches to about 2.5 inches. The water tubes have an outer diameter of about 2.0 inches to about 2.5 inches, while the steam tubes have an outer diameter of about 1.3 inches to about 2.3 inches. The tubes themselves may have a thickness of about 0.2 inches to about 0.5 inches.

In FIG. 8, it is particularly noted that the first vertical ends 232, 272 of the pass-through tubes 230, 270 are offset in the same lateral direction (i.e. in second lateral direction 209) relative to the second vertical ends 234, 274. Also illustrated in FIG. 7 and FIG. 8 is a heat transfer fin 250, which will be discussed in more detail further herein.

Referring now to FIG. 9, which is a top view, the first steam tube 210, first water tube 220, first pass-through tube 230, second steam tube 260, and second water tube 290 of the upper transition casting 200 are marked. The front ends of these tubes 212, 222, 262, 292 are also marked, and it is noted that the front ends all terminate at generally the same distance from the membrane 240. The membrane 240 is vertically aligned and can be considered a rear side of the casting. Heat transfer fin 250 is also visible, and will be discussed in greater detail further herein.

The first steam tube vertical end 214, the first pass-through tube first vertical end 232, and the second steam tube vertical end 264 are all marked. Also marked is the second pass-through tube first vertical end 272. The centers of these vertical ends are marked as 232*c*, 214*c*, 272*c*, and 264*c*, going laterally. As seen here, these vertical ends all have the same diameter, and the centers of these vertical ends are all aligned in a first plane P1, which is a vertical plane that also marks a rear side of the casting. Put another way, the centers of any two of these vertical ends define a first line L1. It is also noted that the centers are evenly spaced apart from each other.

Referring now to FIG. 10, which is a bottom view, the first steam tube 210, first water tube 220, first pass-through tube 230, second steam tube 260, and second water tube 290 of the upper transition casting 200 are marked. The front ends of these tubes 212, 222, 262, 292 are also marked.

The first water tube vertical end 224, the first pass-through tube second vertical end 234, and the second water tube vertical end 294 are all marked. Also marked is the second pass-through tube second vertical end 274. The centers of these vertical ends are marked as 234*c*, 224*c*, 274*c*, and 294*c*, going laterally. As illustrated here, for the lower end of the upper transition casting, and in contrast to that of FIG. 9, the centers of the vertical ends are not all aligned in a single common plane. Rather, they alternate between two different planes. The centers of the pass-through tubes 234*c*, 274*c* are aligned in a plane P1 which is substantially coincident with the first plane P1 of FIG. 9. The centers of the water tubes 224*c*, 294*c* are aligned in a second different plane P2 that is offset from the first plane P1. The center 224*c* of the vertical end of the first water tube 220 is offset from the plane P1 by a distance that is about equal to the radius of the first steam tube 210. Put another way, the center 224*c* of the vertical end of the first water tube 220 and the center 234*c* of the second vertical end of the first pass-through tube 230 define a second line L2. The first line L1 (see FIG. 9) and the second line L2 form an acute angle. In embodiments, the acute angle formed by L1 and L2 has a value of about 15° to about 25°.

Referring still to FIG. 10, membrane 240 is visible joining first pass-through tube 230 to first water tube 220. Membrane 242 is visible joining first water tube 220 to the second vertical end 274 of the second pass-through tube. Membrane 244 is visible joining the second vertical end 274 of the second pass-through tube to the second water tube 290. Membrane 240 can be considered a line (L2) joining the first pass-through tube second vertical end 234 with the first water tube vertical end 224. Membrane 242 can be considered a line (L3) joining the first steam tube vertical end 224 with the second pass-through tube second vertical end 274. The lines L2 and L3 form an obtuse angle at their common point (first water tube vertical end 224). In embodiments, the obtuse angle formed by L2 and L3 has a value of about 130° to about 150°.

Figure 11:
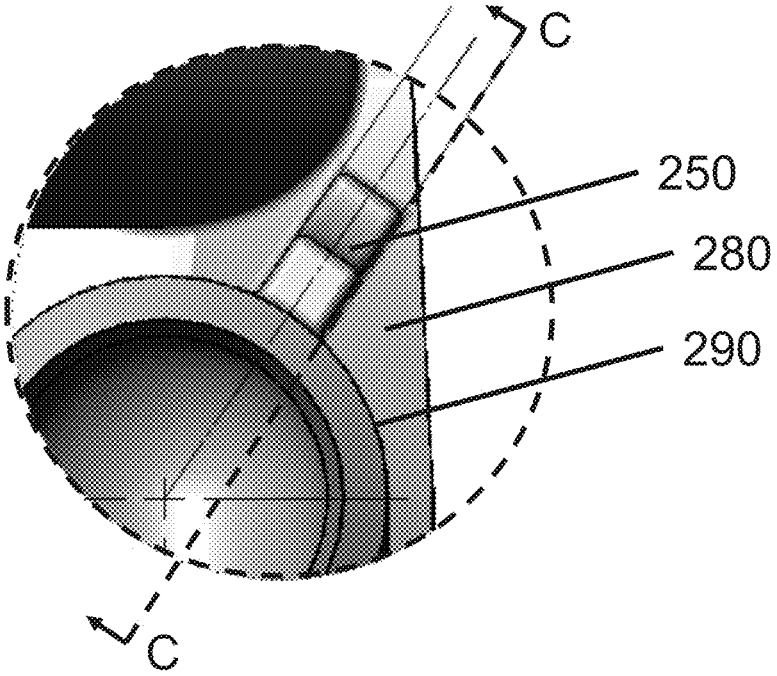
FIG. 11 is a magnified front view of the heat transfer fin in circle B-B in FIG. 8

FIG. 11 is a magnified front view of circle A-A in FIG. 8. Present in this view is membrane wall 280, second water tube 290, and heat transfer fin 250. However, it is noted that the following discussion of the heat transfer fin applies generally to any membrane wall, and water tube. Also visible in FIG. 11 is line C-C, which indicates the cross-section shown in FIG. 12.

Figure 12:
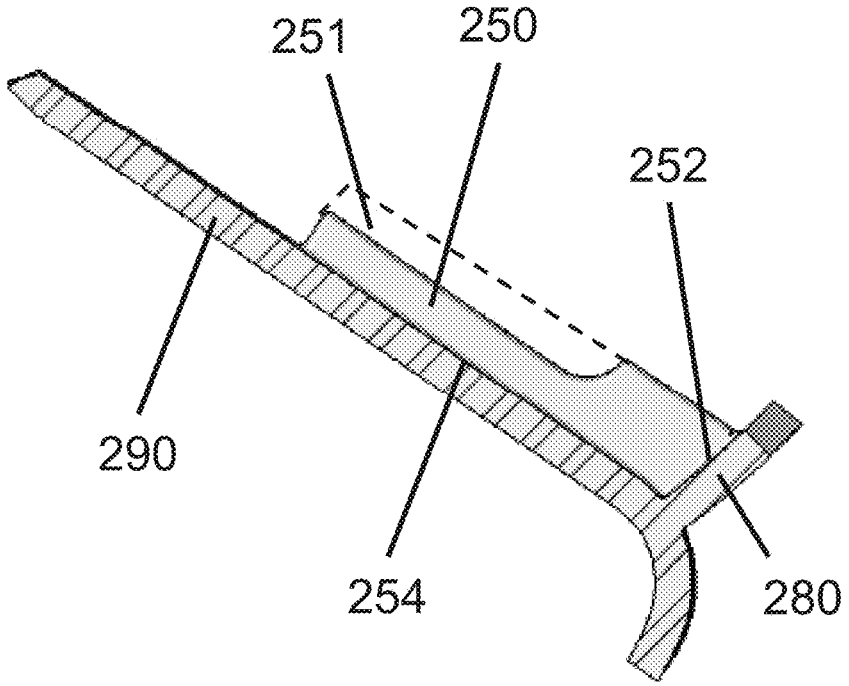
FIG. 12 is a cross-section through line C-C in FIG. 11.

Referring now to FIG. 12, the heat transfer fin 250 is intended to aid in heat transfer from the membrane 280 to the water tube 290, thus keeping the temperature of the membrane lower than without the fin. The heat transfer fin extends from the membrane 280. A first edge 252 of the fin abuts the membrane 280, and a second edge 254 of the fin abuts the water tube 290. The first edge is generally short compared to the second edge. The fin is also coped, as represented by reference numeral 251 (dotted lines indicating material removed from the fin and not present), which can help in providing additional welding space near the steam tube of the casting (not visible).

Figure 13:
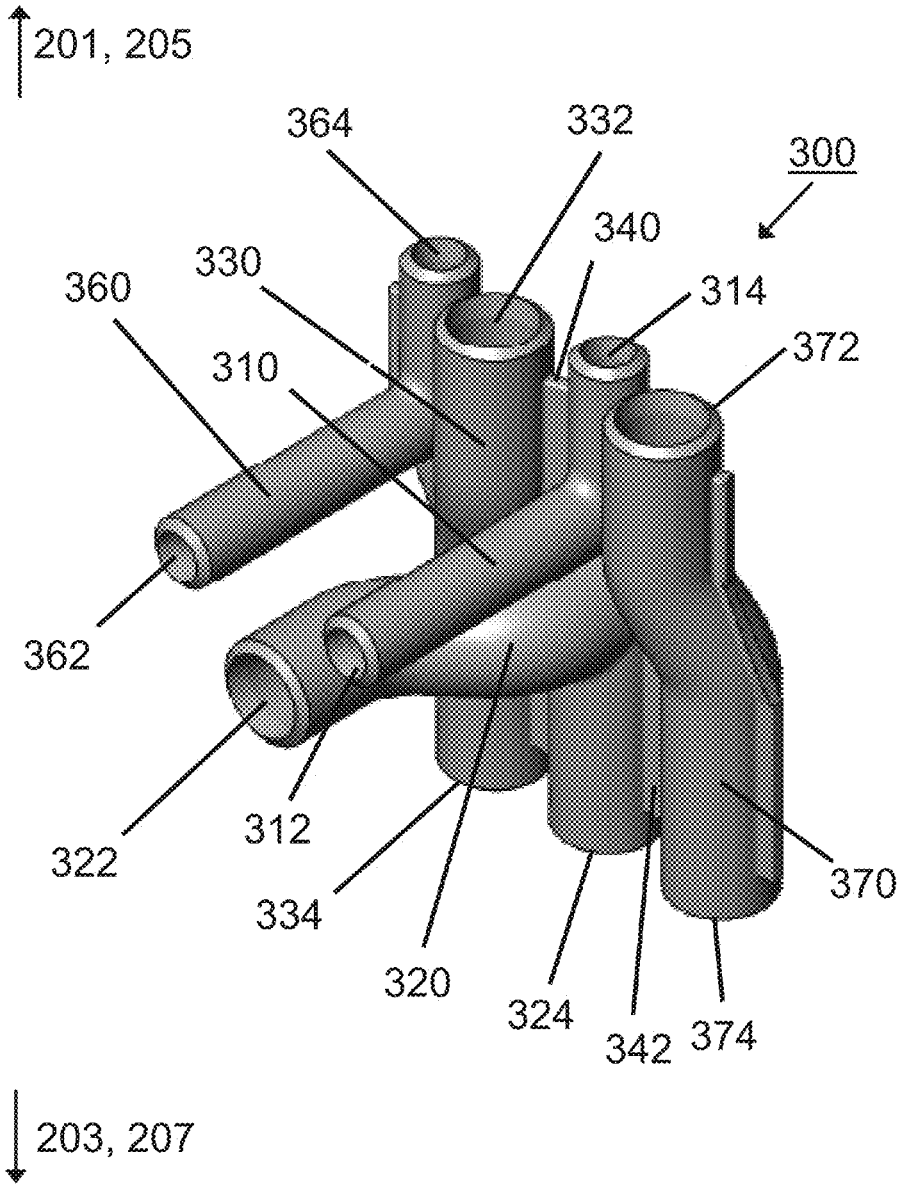
FIGS. 13-16 are different views of a lower transition casting.
Figure 14:
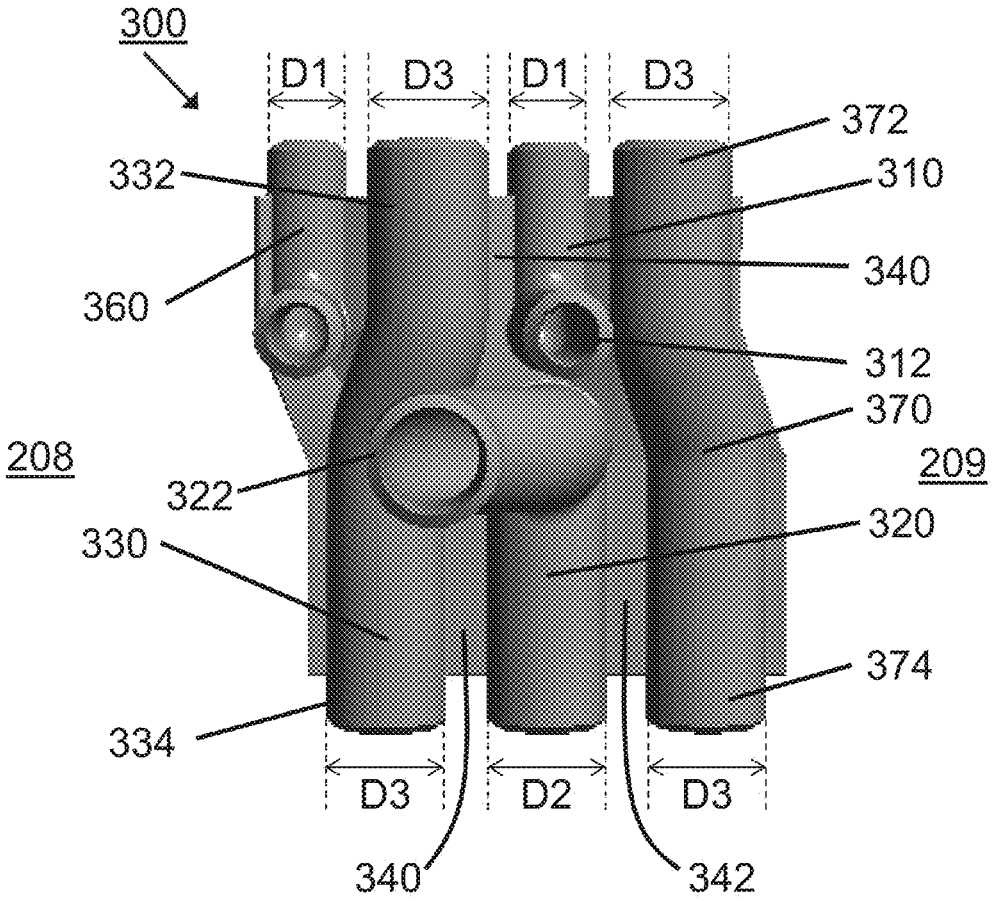
Figure 15:
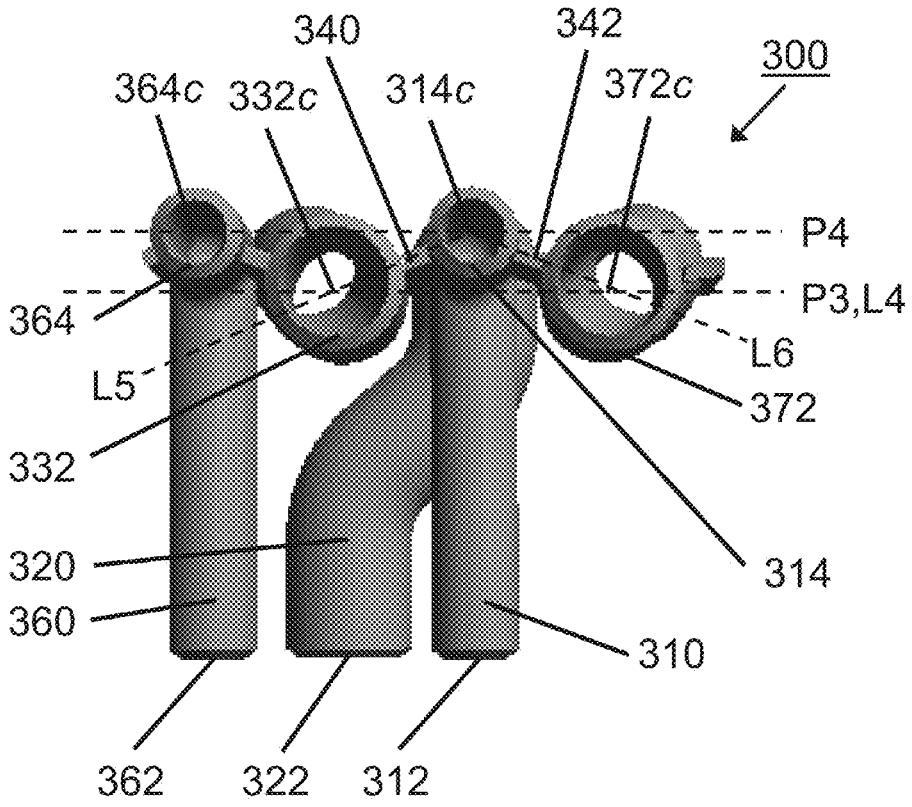
Figure 16:
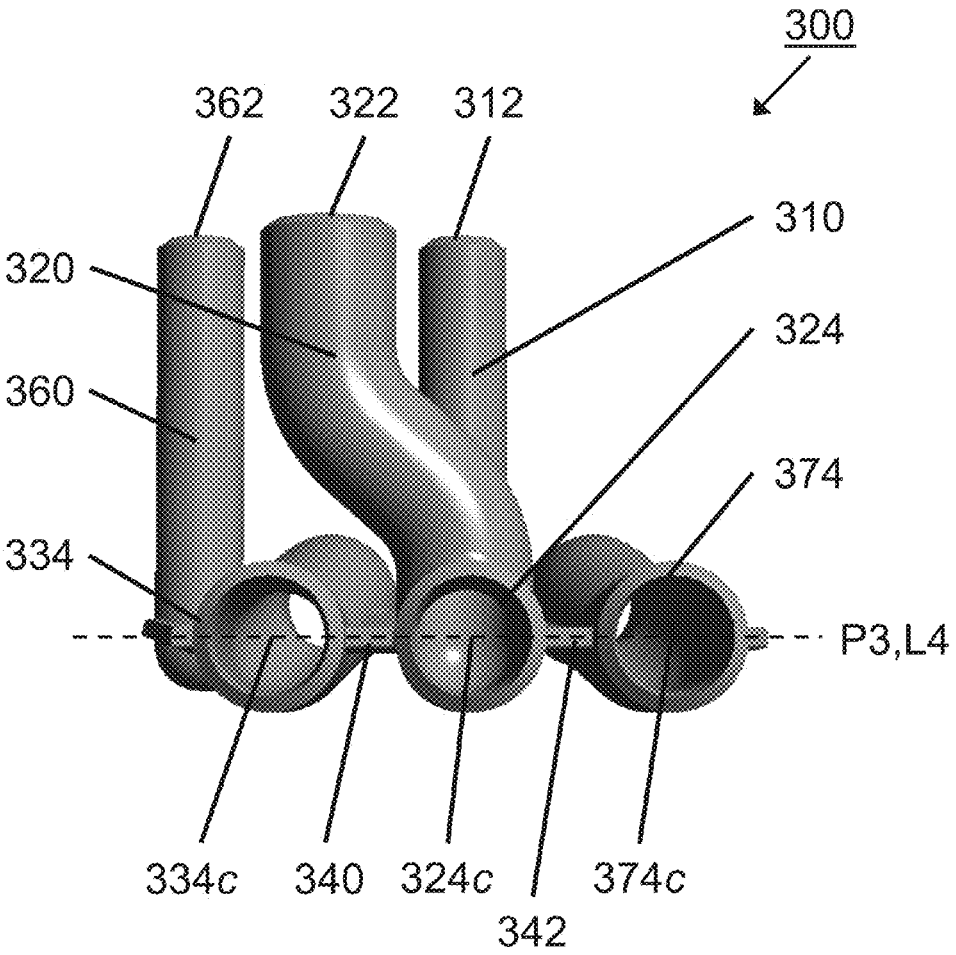

FIGS. 13-16 are different views of the lower transition casting 300. FIG. 13 is a perspective view. FIG. 14 is a front view. FIG. 15 is a top view, and FIG. 16 is a bottom view. The various components of the lower transition casting will now be described below. Again, these figures include arrows indicating a first vertical direction 201, a second vertical direction 203 opposite the first vertical direction, a first lateral direction 208 which is perpendicular to the first vertical direction 201, and a second lateral direction 209 which is opposite the first lateral direction. It is noted that a heat transfer fin 250 is not depicted on the lower transition casting, but that such may be present if desired.

Referring now to FIG. 13 and FIG. 14, the upper transition casting 300 is broadly defined by a first steam tube 310, a first water tube 320, a first pass-through tube 330, and membrane 340 that joins these three tubes 310, 320, 330 together to form a pressure seal. The first steam tube 310 has a steam passageway extending between a front end 312 pointing in the forward direction (i.e. outwardly from the furnace) and a vertical end 314 pointing in first vertical direction 201/upper vertical direction 205. The first water tube 320 has a water passageway extending between a front end 322 that also points in the forward direction and a vertical end 324 pointing in the second vertical direction 203/lower vertical direction 207. The first pass-through tube 330 has a fluid conduit extending between a first vertical end 332 that points in the first vertical direction 201 and a second vertical end 334 that points in the second vertical direction 203. It is noted that the first steam tube 310 and the first water tube 320 do not cross over (i.e. extend past) each other at the middle of the transition casting. Put another way, the front end 312 of the first steam tube is closer to the vertical end 314 of the first steam tube than the front end 322 of the first water tube is. Also, the front end 322 of the first water tube is closer to the vertical end 324 of the first water tube than the front end 312 of the first steam tube is.

The lower transition casting 300 may also have additional steam tubes, water tubes, and pass-through tubes. Here, the lower transition casting also has a second steam tube 360 and a second pass-through tube 370. The second steam tube 360 also has a steam passageway extending between a front end 362 pointing in the forward direction and a vertical end 364 pointing in the first vertical direction 201. The second pass-through tube 370 has a fluid conduit extending between a first vertical end 372 that points in the first vertical direction 201 and a second vertical end 374 that points in the second vertical direction 203. Membrane 342 joins the first steam tube 310, first water tube 320, and the second pass-through tube 370 together to form a pressure seal.

As seen particularly in FIG. 14, the first steam tube 310 and the first water tube 320 are located vertically relative to each other (i.e. one above the other). The first steam tube 310 and the first water tube 320 are both adjacent to a common side of the first pass-through tube 330 (i.e. the first lateral side). The first steam tube 310 and the first water tube 320 are also located between the first pass-through tube 330 and the second pass-through tube 370.

The front end 312 of the first steam tube 310 is laterally offset from the front end 322 of the first water tube 320, i.e. the center of the first steam tube is off to one side of the center of the first water tube. The front end 312 of the first steam tube 310 is also vertically offset from the front end 322 of the first water tube 320, i.e. they are at different heights. Relative to itself, the front end 322 of the first water tube 320 is laterally offset from the vertical end 324 of the first water tube 320, i.e. to one side. In contrast, the front end 312 and the vertical end 314 of the first steam tube 310 are vertically aligned with each other.

As seen in FIG. 14, the first steam tube 310 has a steam tube diameter D1. The first water tube 320 has a water tube diameter D2. The first pass-through tube 330 has a pass-through tube diameter D3. Here because the pass-through tube transports water, the pass-through tube diameter D3 is equal to D2.

In FIG. 14, it is particularly noted that the first vertical ends 332, 372 of the pass-through tubes 330, 370 are offset in different lateral directions relative to their second vertical ends 334, 374. Put another way, the centers of the first vertical ends 332, 372 of the first pass-through tube and the second pass-through tube are closer to each other than the centers of the second vertical ends of the first pass-through tube and the second pass-through tube 334, 374.

FIG. 15 and FIG. 16 are a top view and a bottom view, respectively, of the lower transition casting. It is noted that the top view of the lower transition casting corresponds to the bottom view of the upper transition casting (FIG. 10). Thus, we will discuss the bottom view of the lower transition casting first.

Referring now to FIG. 16, which is a bottom view for the lower transition casting 300, the first steam tube 310, first water tube 320, and second steam tube 360 of the lower transition casting 300 are marked. The front ends of these tubes 312, 322, 362 are also marked, and it is noted that the front ends all terminate at generally the same distance from the membrane 340. The membrane 340 is vertically aligned and can be considered a rear side of the casting.

The first water tube vertical end 324, the first pass-through tube second vertical end 334, and the second pass-through tube second vertical end 374 are all marked. The centers of these vertical ends are marked as 334*c*, 324*c*, and 374*c*, going laterally. As seen here, these vertical ends all have the same diameter, and the centers of these vertical ends are all aligned in a third plane P3, which is a vertical plane that also marks a rear side of the casting. Put another way, the centers of any two of these vertical ends define a fourth line L4.

Referring now to FIG. 15, which is the top view of the lower transition casting, the first steam tube 310, first water tube 320, and second steam tube 360 of the lower transition casting 300 are marked. The front ends of these tubes 312, 322, 362 are also marked.

The second steam tube vertical end 364, the first pass-through tube first vertical end 332, the first steam tube vertical end 314, and the second pass-through tube first vertical end 372 are all marked. The centers of these vertical ends are marked as 364*c*, 332*c*, 314*c*, and 372*c*, going laterally. As illustrated here, for the upper end of the lower transition casting, and in contrast to that of FIG. 16, the centers of the vertical ends are not all aligned in a single common plane. Rather, they alternate between two different planes. The centers of the pass-through tubes 332*c*, 372*c* are aligned in a plane P3 which is substantially coincident with the third plane P3 of FIG. 16. The centers of the steam tubes 364*c*, 314*c* are aligned in a fourth different plane P4 that is offset from the third plane P3. The center 314*c* of the vertical end of the first steam tube 310 is offset from the plane P3 by a distance that is about equal to the radius of the first steam tube 310. Put another way, the center 314*c* of the vertical end of the first steam tube 310 and the center 332*c* of the first vertical end of the first pass-through tube 330 define a fifth line L5. The fourth line L4 (see FIG. 16) and the fifth line L5 form an acute angle. In embodiments, the acute angle formed by L4 and L5 has a value of about 15° to about 25°.

Referring still to FIG. 15, membrane 340 is visible joining first pass-through tube 330 to first steam tube 310. Membrane 342 is visible joining first steam tube 310 to the first vertical end 372 of the second pass-through tube. Membrane 340 can be considered a line (L5) joining the first pass-through tube first vertical end 332 with the first steam tube vertical end 314. Membrane 342 can be considered a line (L6) joining the first steam tube vertical end 314 with the second pass-through tube first vertical end 374. The lines L5 and L6 form an obtuse angle at their common point (first steam tube vertical end 314). In embodiments, the obtuse angle formed by L5 and L6 has a value of about 130° to about 150°.

The transition castings 200, 300 can be made by casting, which is a process in which a liquid metal is poured into a mold and solidified as one piece. This also allows the bends in the various tubes to be made at a much smaller radius compared to normal bent tubes. The smaller radius permits a narrower membrane area, which produces lower membrane metal temperatures and therefore longer service life.

The transition castings are preferably made with materials which can accommodate the high temperatures needed to handle the superheated steam. For example, SA217C12a, SA217WC9 or SA217WC7 or SA217WC6 steel could be used. The castings are welded to the wall tubes of the upper furnace and the lower furnace, and their use permits access for welding the various tubes and headers together.

The present disclosure has been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

We claim:

1. A transition casting, comprising:

a first steam tube having a steam tube diameter, a front end, a vertical end, and a steam passageway extending between the front end and the vertical end, wherein the front end points in a forward direction and the vertical end points in a first vertical direction;

a first water tube having a water tube diameter, a front end, a vertical end, and a water passageway extending between the front end and the vertical end, wherein the front end points in the forward direction and the vertical end points in a second vertical direction opposite the first vertical direction;

a first pass-through tube having a pass-through tube diameter, a first vertical end, a second vertical end, and a fluid conduit extending between the first vertical end and the second vertical end, wherein the first vertical end points in the first vertical direction and the second vertical end points in the second vertical direction; and a membrane joining the first steam tube, the first water tube, and the first pass-through tube to form a pressure seal therebetween, wherein the first steam tube and the first water tube are located one above the other;

wherein a center of the vertical end of the first steam tube and a center of the first vertical end of the first pass-through tube are aligned in a first plane, and a center of the vertical end of the first water tube is offset from the first plane;

wherein the first steam tube and the first water tube do not cross over each other at a middle of the transition casting;

wherein the first water tube and the first steam tube are both adjacent to a common side of the first pass-through tube; and wherein the transition casting is one piece made by casting.

2. A transition casting, comprising a first steam tube having a steam tube diameter and a steam passageway extending between a front end pointing in a forward direction and a vertical end pointing in a first vertical direction;

a first water tube having a water tube diameter and a water passageway extending between a front end pointing in the forward direction and a vertical end pointing in a second vertical direction opposite the first vertical direction;

a first pass-through tube having a pass-through tube diameter and a fluid conduit extending between a first vertical end pointing in the first vertical direction and a second vertical end pointing in the second vertical direction; and a membrane joining the first steam tube, the first water tube, and the first pass-through tube to form a pressure seal therebetween, wherein the first steam tube and the first water tube are located one above the other;

wherein a center of the vertical end of the first steam tube and a center of the first vertical end of the first pass-through tube define a first line;

wherein a center of the vertical end of the first water tube and a center of the second vertical end of the first pass-through tube define a second line; and wherein the first line and the second line form an acute angle;

wherein the first steam tube and the first water tube do not cross over each other at a middle of the transition casting; and wherein the transition casting is one piece made by casting.

3. The transition casting of claim 2, wherein the first water tube and the first steam tube are both adjacent to a common side of the first pass-through tube.

4. The transition casting of any one of claims 1 and 3, wherein the front end of the first steam tube is both laterally and vertically offset from the front end of the first water tube.

5. The transition casting of claim 4, wherein the front end and the vertical end of the first steam tube are vertically offset from each other.

6. The transition casting of claim 5, wherein the front end and the vertical end of the first water tube are vertically aligned with each other.

7. The transition casting of claim 6, further comprising a heat transfer fin extending from the membrane and abutting the first water tube.

8. The transition casting of claim 7, wherein the water tube diameter is greater than the steam tube diameter.

9. The transition casting of claim 8, wherein the pass-through tube diameter is the same as the steam tube diameter.

10. The transition casting of claim 8, wherein the pass-through tube diameter is the same as the water tube diameter.

11. The transition casting of claim 8, further comprising a second pass-through tube having the pass-through tube diameter and a fluid conduit extending between a first vertical end pointing in the first vertical direction and a second vertical end pointing in the second vertical direction;

wherein the first steam tube and the first water tube are located vertically relative to each other and are located between the first pass-through tube and the second pass-through tube.

12. The transition casting of claim 11, wherein the first vertical ends of the first pass-through tube and the second pass-through tube are offset in the same lateral direction relative to the second vertical ends of the first pass-through tube and the second pass-through tube.

13. The transition casting of claim 12, wherein two lines joining (i) the second vertical end of the first pass-through tube with the vertical end of the first water tube, and (ii) the vertical end of the first water tube with the second vertical end of the second pass-through tube, form an obtuse angle.

14. The transition casting of claim 11, wherein the centers of the first vertical ends of the first pass-through tube and the second pass-through tube are closer to each other than the centers of the second vertical ends of the first pass-through tube and the second pass-through tube.

15. The transition casting of claim 14, wherein two lines joining (i) the first vertical end of the first pass-through tube with the vertical end of the first steam tube, and (ii) the vertical end of the first steam tube with the first vertical end of the second pass-through tube, form an obtuse angle.

16. A boiler, comprising:

an upper furnace having steam-cooled membrane walls comprising steam wall tubes;

a lower furnace having water-cooled membrane walls comprising water wall tubes; and a transition section disposed between the upper furnace and the lower furnace, wherein the transition section comprises an upper transition casting and a lower transition casting that are joined by alternating straight water tubes and straight steam tubes;

wherein the upper transition casting comprises an upper steam tube having a steam tube diameter and a steam passageway extending between a front end pointing in a forward direction and an upper end pointing in an upper vertical direction;

an upper water tube having a water tube diameter and a water passageway extending between a front end pointing in the forward direction and a lower end pointing in a lower vertical direction;

a steam pass-through tube having the steam tube diameter and a fluid conduit extending between an upper end pointing in the upper vertical direction and a lower end pointing in the lower vertical direction; and a membrane joining the upper steam tube, the upper water tube, and the steam pass-through tube to form a pressure seal therebetween, wherein the upper steam tube and the upper water tube are located one above the other;

wherein a center of the upper end of the upper steam tube and a center of the upper end of the steam pass-through tube are aligned in a first plane, and a center of the lower end of the upper water tube is offset from the first plane, wherein the upper steam tube and the upper water tube do not cross over each other at a middle of the transition casting, and wherein the upper transition casting is one piece made by casting;

wherein the lower transition casting comprises a lower steam tube having the steam tube diameter and a steam passageway extending between a front end pointing in the forward direction and an upper end pointing in the upper vertical direction;

a lower water tube having the water tube diameter and a water passageway extending between a front end pointing in the forward direction and a lower end pointing in the lower vertical direction;

a water pass-through tube having the water tube diameter and a fluid conduit extending between an upper end pointing in the upper vertical direction and a lower end pointing in the lower vertical direction; and a membrane joining the lower steam tube, the lower water tube, and the water pass-through tube to form a pressure seal therebetween, wherein the lower steam tube and the lower water tube are located one above the other;

wherein a center of the lower end of the lower steam tube and a center of the lower end of the steam pass-through tube are aligned in a second plane, and a center of the upper end of the lower steam tube is offset from the second plane, wherein the lower steam tube and the lower water tube do not cross over each other at a middle of the transition casting, and wherein the lower transition casting is one piece made by casting.

17. The boiler of claim 16, wherein the upper transition casting further comprises a heat transfer fin extending from the membrane and abutting the upper water tube.

18. The boiler of claim 17, wherein the lower transition casting further comprises a heat transfer fin extending from the membrane and abutting the lower water tube.

19. The boiler of claim 18, wherein the upper steam tube and the lower steam tube are each fluidly connected to a steam inlet header located below the lower transition casting; and the upper water tube and the lower water tube are each fluidly connected to a water outlet header located above the upper transition casting.

20. The boiler of claim 19, wherein the castings support the load of the lower furnace and the castings are supported by the upper furnace.

21. The boiler of claim 20, wherein the centers of the water tubes are located in a different plane from the centers of the steam tubes.

22. The boiler of claim 21, wherein the steam from the steam cooled circuit is drainable.

23. The boiler of claim 21, where water from the water cooled circuit is ventable to the atmosphere.

* * * * *